US007729639B2

(12) United States Patent
Deguchi et al.

(10) Patent No.: US 7,729,639 B2
(45) Date of Patent: Jun. 1, 2010

(54) CHARGING APPARATUS AND IMAGE FORMING APPARATUS

(75) Inventors: Masanobu Deguchi, Kashiba (JP); Syouichi Fujita, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 403 days.

(21) Appl. No.: 11/723,471

(22) Filed: Mar. 20, 2007

(65) Prior Publication Data

US 2007/0217822 A1 Sep. 20, 2007

(30) Foreign Application Priority Data

Mar. 20, 2006 (JP) ..... P2006-077804
Mar. 20, 2006 (JP) ..... P2006-077805

(51) Int. Cl.
*G03G 15/02* (2006.01)

(52) U.S. Cl. ..... 399/170; 399/171; 399/173

(58) Field of Classification Search ..... 399/170, 399/171, 173
See application file for complete search history.

(56) References Cited

U.S. PATENT DOCUMENTS

| | | | | |
|---|---|---|---|---|
| 5,666,604 | A | 9/1997 | Nakagami et al. | |
| 6,025,594 | A * | 2/2000 | Bryce et al. | 399/170 X |
| 6,261,720 | B1 * | 7/2001 | Kimiya et al. | 429/223 |
| 2005/0047829 | A1 | 3/2005 | Nakane et al. | |

FOREIGN PATENT DOCUMENTS

| | | | |
|---|---|---|---|
| JP | 61231573 | A * | 10/1986 |
| JP | 05-163581 | | 6/1993 |
| JP | 05-163582 | | 6/1993 |
| JP | 06-035294 | | 2/1994 |
| JP | 10-007973 | | 1/1998 |
| JP | 11-024373 | | 1/1999 |
| JP | 11-040316 | | 2/1999 |
| JP | 2001-166569 | | 6/2001 |
| JP | 2001-226798 | | 8/2001 |
| JP | 2002365835 | A * | 12/2002 |
| JP | 2003-270993 | | 9/2003 |
| JP | 2004-004334 | | 1/2004 |

OTHER PUBLICATIONS

JP 2005-99670 (Apr. 2005) claiming priority to same application as U.S. Patent Application Publication No. 2005/0047829.
JP 8-171257 (Jul. 1996) claiming priority to same application as U.S. Patent No. 5,666,604.

* cited by examiner

*Primary Examiner*—David M Gray
*Assistant Examiner*—Erika Villaluna
(74) *Attorney, Agent, or Firm*—Nixon & Vanderhye P.C.

(57) ABSTRACT

There is provided a charging apparatus which has high durability and suffers from no rust etc. and of which controllability of charged potential of a photoreceptor is hardly impaired even with a some amount of contaminants such as a toner so that control of charged potential of a photoreceptor can be stably carried out to fall in an appropriate range over a long period of time, and moreover which is inexpensive. A charging apparatus includes a needle electrode, a holding member, two cleaner members, a support member, a moving member, a shield case, and a grid electrode. A length in minor axis of a secondary aggregate of polytetrafluoroethylene contained in a polytetrafluoroethylene-containing nickel layer formed on a surface of the needle electrode is twice or less than a layer thickness of the nickel layer.

19 Claims, 6 Drawing Sheets

CHARGING APPARATUS AND IMAGE FORMING APPARATUS

CROSS-REFERENCE TO RELATED APPLICATION

This application claims priorities to Japanese Patent Application Nos. 2006-077804 and 2006-077805, which were filed on Mar. 20, 2006, the contents of which, are incorporated herein by reference, in their entirety.

BACKGROUND OF THE INVENTION

1. Field of the Invention

The present invention relates to a charging apparatus and an image forming apparatus.

2. Description of the Related Art

In electrophotographic image forming apparatuses such as copying machines, printers and facsimile units, images are formed as follows. By imparting electric charges to a surface of a photoreceptor on which surface a photosensitive layer is formed as an image bearing member and contains a photoconductive substance, the surface of the photoreceptor is uniformly charged. Subsequently, an electrostatic latent image corresponding to image information are formed in various image forming processes. The electrostatic latent image is developed by a toner-containing developer supplied from a developing section, so as to obtain a visible image which is then transferred onto a recording material such as paper. After that, the visible image is fixed on the recording material by heat and pressure given by a fixing roller so that an image is formed on a recording sheet.

In the image forming apparatus as described above, a charging apparatus is used for charging the surface of the photoreceptor. The charging apparatus is composed of: a discharging electrode for conducting corona discharge on the photoreceptor; a grid electrode which is an electrode disposed between the surface of the photoreceptor and the discharging electrode and to which appropriate voltage is applied, for controlling an amount of charges imparted from the discharging electrode to the surface of the photoreceptor, and thus carrying out control of charged potential of the surface of the photoreceptor; and a support member for supporting the discharging electrode and the grid electrode. Since the grid electrode is capable of nearly precisely controlling the charged potential of the surface of the photoreceptor, a charging apparatus provided with the grid electrode is becoming predominant at present.

As the discharging electrode for the charging apparatus, for example, there are used a wire electrode and a metal plate electrode having a plurality of needle portions (hereinafter referred to as "needle electrode"). Among them, the needle electrode is preferably used because of its advantages such as a less number of components, a longer operating life, less generation amount of ozone, and less frequent failures by virtue of no disconnection. The needle electrode is manufactured by etching a metal plate which is mainly made of an iron-based metal material such as stainless steel, to form a plurality of needle portions in the metal plate. The needle electrode manufactured by etching is also referred to as an etched electrode. An etched cross section of the needle electrode lacks in the smoothness. Further, a plurality of edges for conducting discharge are present at the top end of the needle portion, and shapes of the edges present at the top ends of a plurality of needle portions are not uniform. Accordingly, discharges from the respective needle portions are not uniform. As a result, it is not possible to sufficiently control the charged potential of the surface of the photoreceptor, so that the potential of the charged surface of the photoreceptor becomes uneven.

Further, the material for the needle electrode, i.e. the iron-based metal material such as stainless steel has high durability, but involves a drawback of being easily oxidized due to moisture under a high humidity circumstances and due to ozone generated by corona discharging during a charging operation. Moreover, in a long-time use of the needle electrode, a use of the needle electrode under the high humidity circumstance, a contact of the needle electrode with ozone, etc. are inevitable. Accordingly, the needle electrode made of a metal material such as stainless steel corrodes due to moisture in air or due to ozone etc., resulting in deterioration of durability thereof. In addition, there is lowered controlling performance for high voltage applied to the needle electrode for conducting the corona discharge from the needle portion, with the result that the potential of the charged surface of the photoreceptor is uneven, causing a to-be-solved problem that the surface of the photoreceptor cannot be constantly charged to a desired potential in a stable manner. Further, as in the case of the needle electrode, the wire electrode also involves a to-be-solved problem such that ozone generated by corona discharge leads rust, corrosion, or other troubles which cause the potential of the charged surface of the photoreceptor to be uneven.

In view of the foregoing problems in the charging apparatus, there has been proposed, for example, a charging apparatus including: a wire electrode extended in a shield case having one surface thereof open; and a plate grid electrode arranged between the wire electrode and the photoreceptor, the plate grid electrode which is formed by applying a nickel plated layer of about 1 μm thickness on a surface of a porous stainless steel plate and further forming thereon a gold plated layer of about 0.3 μm thickness (refer to, for example, Japanese Unexamined Patent Publication JP-A 11-40316 (1999)). In the plate grid electrode of JP-A 11-40316, the gold plated layer is formed on the porous stainless steel plate by way of the nickel plated layer so that the gold plated layer is less easily peeled off, and the corrosion resistance and the controllability of charged potential of the surface of the photoreceptor are relatively satisfactory.

However, the manufacture of the plate grid electrode requires two plating steps, i.e., nickel plating and gold plating. This poses drawbacks such as more complicated manufacturing step and increase of the cost. Further, in order to make this plate grid electrode sufficiently exhibit the preferred characteristics as described above, a thickness of the gold plated layer needs to be set at 0.3 μm or more. In addition, since the plate grid electrode is a relatively large member having a substantially the same size as the photoreceptor, the usage of gold is necessarily increased also because of the necessity for increasing the thickness of the plated layer. However, such a heavy usage of gold unnecessarily increases the cost of the charging apparatus and thus the cost of the image forming apparatus, resulting in loss of the general applicability of the image forming apparatus based on its relatively low price which is one of the advantages of the image forming apparatus. Accordingly, there has been a demand for realizing, without using an expensive material such as gold, a charging apparatus having the needle electrode and the plate grid electrode which are excellent in durability and controllability of charged potential of the surface of the photoreceptor.

Further, there has been proposed a charging apparatus including: a wire electrode; and a plate grid electrode which is obtained by forming a gold plated layer directly on a surface of a stainless steel metal plate by an electrolytic plating method using a pulse current, as in the case of JP-A 11-40316 (refer to, for example, Japanese Unexamined Patent Publication JP-A 2001-166569). Also in this plate grid electrode, the gold plated layer is less easily peeled off and, like the plate grid electrode in JP-A 11-40316, the corrosion resistance is high and the controllability of charged potential of the surface of the photoreceptor are also favorable. However, also in this plate grid electrode, a thickness of the gold metal layer needs to be set at 0.3 μm or more, it involves the same drawbacks as those in the charging apparatus of JP-A 11-40316.

On the other hand, it has also been proposed to coat the discharging electrode with gold (refer to, for example, Japanese Unexamined Patent Publication JP-A 2004-4334). The charging apparatus of JP-A 2004-4334 includes a needle electrode on a surface of which a coating layer made of gold, platinum, copper, nickel or chromium is formed by plating. In JP-A 2004-4334, a method of etching, precision pressing, or the like method is used for forming the needle electrode, but the cross section of the needle electrode obtained by the method lacks in smoothness and results in fine irregularities. Accordingly, even after applying the plating, fine irregularities on the cross section remain as they are and may disturb the balance of the corona discharging, causing the surface of the photoreceptor to be charged to uneven potential. Further, contaminants such as a toner are easily deposited on the fine irregularities. That is, the needle electrode of JP-A 2004-4334 has a drawback that contaminants such as the toner are attached thereto during a long-time use and this causes the charged surface of the photoreceptor to have further uneven potential.

As the grid electrode, for example, there are used a wire grid electrode made of stainless steel, tungsten or the like ingredient, and a porous plate grid electrode formed of a metal plate (grid substrate) of stainless steel or the like ingredient with a large number of perforations. Note that, upon manufacturing the porous plate grid electrode, etching or other methods can be adopted for making the perforations in the metal plate. The porous plate grid electrode manufactured by etching is referred to as an etching grid. Contaminants such as a toner are easily deposited on the wire grid electrode among the grid electrodes described above. Due to such deposition of the contaminants, the function for control of charged potential of the surface of the photoreceptor becomes insufficient, and this causes a problem that the potential of the charged surface of the photoreceptor is further uneven.

On the other hand, in the case of using the porous plate grid electrode which has a relatively large area compared to the wire grid electrode, the charged potential of the surface of the photoreceptor can be controlled to fall in an appropriate range and in addition, the controllability for the charged potential is decreased to a smaller extent even when the contaminants are deposited more or less. Further, the porous plate grid electrode is made of an iron-based metal material such as stainless steel as described above, and therefore exhibits high durability and does not cause troubles such as deformation even after a long-time use, with the result that the change of the controllability for the charged potential due to deformation or the like is extremely small. Accordingly, it is considered that the porous plate grid electrode can control the charged potential of the surface of the photoreceptor so as to be substantially constant for a long period of time.

The material for the porous plate grid electrode, i.e. the iron-based metal material such as stainless steel has usually high durability, but involves a drawback of being easily oxidized due to moisture under a high humidity circumstances and ozone generated by corona discharging during a charging operation. In a long-time use of the porous plate grid electrode, a use of the porous plate grid electrode under the high humidity circumstance, a contact of the porous plate grid electrode with ozone, etc. are inevitable. Accordingly, the porous plate grid electrode made of a metal material such as stainless steel corrodes due to moisture in air or due to ozone etc., thus causing a nitrogen oxide to be deposited on the surface of the porous plate grid electrode which is thereby deteriorated in durability. In addition, the ability of controlling the charged potential of the surface of the photoreceptor is decreased to an insufficient level, and with the result that the potential of the charged surface of the photoreceptor is uneven, causing a problem that the surface of the photoreceptor cannot be constantly charged to a desired potential in a stable manner.

In view of the problems of the porous plate grid electrode as described above, there has been proposed a corona charging apparatus having a grid electrode composed of a metal plate (grid substrate) made of stainless steel, and a nickel plated layer and a gold plated layer which are sequentially coated on a surface of the grid electrode (refer to, for example, Japanese Unexamined Patent Publication JP-A 11-40316 (1999)). In the grid electrode, improvement is indeed recognized to some extent in view of the corrosion resistance. However, the grid electrode involves a drawback that the gold plated layer which serves as a main factor for enhancing the corrosion resistance, is easily peeled off. Although JP-A 11-40316 discloses that the nickel plated layer is formed between the metal plate and the gold plated layer in order to prevent the gold plated layer from being peel off, the effect is not yet satisfactory.

Further, there has been proposed a charging apparatus having a grid electrode formed by applying a gold plated layer directly to a stainless steel-made metal plate (grid substrate) without interposing a nickel plated layer therebetween by an electrolytic plating method using a pulse current (refer to, for example, Japanese Unexamined Patent Publication JP-A 2001-166569). The charging apparatus is adopted in an image forming apparatus including: an organic photoreceptor on which an electrostatic latent image is formed; a charging apparatus for charging the organic photoreceptor; a developer for developing the electrostatic latent imaged formed on the organic photoreceptor into a toner image; a transfer portion for transferring the toner image onto a recording material; and a fixing device for fixing the transferred toner image on the recording material. In the charging apparatus, the gold plated layer is less easily peeled off and therefore, the corrosion resistance and the controllability of charged potential of the surface of the photoreceptor are satisfactory. By the way, in order to make this grid electrode sufficiently exhibit the preferred characteristics as described above, a thickness of the gold plated layer needs to be set at 0.3 μm or more. In addition, since the grid electrode is a relatively large member having a substantially the same size as the photoreceptor, the usage of gold is necessarily increased also because of the necessity for increasing the thickness of the plated layer. However, such a heavy usage of gold unnecessarily increases the cost of the charging apparatus and thus the cost of the image forming apparatus, resulting in loss of the general applicability of the image forming apparatus based on its relatively low price, which is one of the advantages of the image forming apparatus. Accordingly, there has been a demand for realizing, without using an expensive material such as gold, a charging apparatus having the needle electrode and the grid electrode which are excellent in durability and controllability of charged potential of the surface of the photoreceptor.

SUMMARY OF THE INVENTION

An object of the invention is to provide a charging apparatus having high durability, of which controllability of charged potential of a photoreceptor is hardly impaired even with a some amount of contaminants such as a toner so that control of charged potential of a photoreceptor can be stably carried out to fall in an appropriate range over a long period of time, and moreover which is inexpensive, as well as an image forming apparatus including the charging apparatus, which is capable of recording high-quality images over a long period of time.

The invention provides a charging apparatus mounted in an electrophotographic image forming apparatus including a photoreceptor to be opposite to a surface of the photoreceptor, the charging apparatus comprising:

a discharging electrode having a plurality of pointed protrusions, that applies voltage to the surface of the photoreceptor to charge the surface of the photoreceptor; and a grid electrode disposed between the discharging electrode and the photoreceptor, that controls a charged potential of the surface of the photoreceptor, wherein at least one of surfaces of the discharging electrode is provided with a polytetrafluoroethylene-containing nickel layer which contains a secondary aggregate of polytetrafluoroethylene, and a length in minor axis of the secondary aggregate of polytetrafluoroethylene contained in the polytetrafluoroethylene-containing nickel layer is twice or less than a layer thickness of the polytetrafluoroethylene-containing nickel layer.

According to the invention, in the charging apparatus comprising a discharging electrode having the plurality of pointed protrusions and the grid electrode, at least one surface of the discharging electrode is coated with the polytetrafluoroethylene-containing nickel layer (hereinafter referred to as "nickel-PTFE composite layer"), and the length in minor axis of the secondary aggregate of polytetrafluoroethylene (hereinafter referred to as "PTFE secondary aggregate") contained in the nickel-PTFE composite layer is twice or less than the layer thickness of the nickel-PTFE composite layer. As a result, pinholes formed in a surface of the nickel-PTFE composite layer mainly attributable to fall of the PTFE secondary aggregate have almost no negative impact on the corona discharging performance of the discharging electrode, thus leading significant enhancement in corona discharging performance of the discharging electrode with respect to the surface of the photoreceptor so that a charged potential of the surface of the photoreceptor can be controlled to fall in an appropriate range and to be even. Further, the discharging electrode has high durability and is capable of stably exhibiting excellent coronal discharging performance over a long period of time.

Moreover, the length in minor axis of the pinhole generated mainly attributable to fall of the PTFE secondary aggregate from the surface of the nickel-PTFE composite layer is twice or less than the layer thickness of the nickel-PTFE composite layer and therefore, the discharging electrode coated with the nickel-PTFE composite layer is seldom oxidized to corrode, and contaminants such as a toner are hardly attached to the needle electrode. In particular, a widely-used toner (hereinafter referred to as "hydrophobic toner") adapted for increase in image forming speed, which contains hydrophobic silica as an external additive, is easily attached to the discharging electrode, thus frequently causing gradual decrease in discharging performance of the discharging electrode. However, when the nickel-PTFE composite layer having a structure described above is formed, even the hydrophobic toner is far less frequently attached to the surface of the discharging electrode. Moreover, if the hydrophobic toner is attached to the surface of the discharging electrode, such a hydrophobic toner can be easily removed by a simple cleaning device. Accordingly, by use of the image forming apparatus provided with the charging apparatus containing the discharging electrode, it is possible to stably record over a long period of time high-quality images of which quality changes within an extremely narrow range even in the case of high-speed image formation. In addition, the charging apparatus needs almost no maintenance work. Furthermore, the discharging electrode is not a gold plated layer which is used in the related art, but an only nickel-PTFE composite layer formed on the surface of the substrate, resulting in an advantage of lower cost compared to the case of using the discharging electrode formed of the gold plated layer.

Reasons why excellent effects can be brought by the above-described configuration are speculated as follows. For example, a consideration is given to a case of employing electroless plating to form the nickel-PTFE composite layer. Since the plated layer growing by the electroless plating has no directional character, the nickel-PTFE composite layer grows so as to cover a surface of PTFE primary particle or PTFE secondary aggregate. However, the PTFE secondary aggregate having a length in minor axis thereof larger than twice the layer thickness of the nickel-PTFE composite layer, is exposed on the surface of the nickel-PTFE composite layer and then falls therefrom by a water washing process or the like cause, resulting in generation of a pinhole and decrease of PTFE content to thus reduce an effect obtained by containing PTFE (hereinafter referred to as "PTFE's effect"). Further, in the case where the length in minor axis of the secondary aggregate is close to twice the layer thickness of the nickel-PTFE composite layer, even the nickel-PTFE composite layer covering the surface of the secondary aggregate is thin in center part of the secondary aggregate and thus has low mechanical strength so that the PTFE-secondary aggregate easily falls by a water washing process or the like cause, resulting in generation of a pinhole which has a negative impact on the corona discharging performance of the discharging electrode and resulting in decrease of PTFE content to thus reduce the PTFE's effect.

Further, in the invention, it is preferable that the polytetrafluoroethylene-containing nickel layer is formed on the discharging electrode or a surface of the nickel layer formed on the surface of the discharging electrode, and a length in minor axis of a defect part in the discharging electrode or surface of the nickel layer coated with the polytetrafluoroethylene-containing nickel layer is twice or less than the layer thickness of the polytetrafluoroethylene-containing nickel layer.

According to the invention, the nickel-PTFE composite layer is formed on the discharging electrode or the surface of the nickel layer formed on the surface of the discharging electrode, and the length in minor axis of the defect part in the discharging electrode or surface of the nickel layer coated with the nickel-PTFE composite layer is twice or less than the layer thickness of the polytetrafluoroethylene-containing nickel layer, in a consequence whereof the corona discharging performance of the discharging electrode is further enhanced, and the corona discharging performance of the needle electrode is not only enhanced but also maintained at high level over a long period of time. Accordingly, a range of unevenness in charged potential of the surface of the photoreceptor becomes very narrow, and it is therefore possible to obtain images of uniform quality at any time even in the case of copying or printing 100,000 sheets, for example. Herein, "the defect part" means a recess formed by contact with other objects or the like cause, and a part on which an impurity, an oxide film, and the like material remaining due to cleaning defects etc. are deposited.

Reasons why excellent effects can be brought by the above-described configuration are speculated as follows. In general, it is difficult to form a plated layer of which defect part is given sufficient layer thickness and mechanical strength by plating. And thus, a to-be-plated defect-free surface adjacent to the defect part is plated with a plated layer having a sufficient layer thickness and mechanical strength. Since the plated layer growing by the electroless plating has no directional character, the plated layer plating the to-be-plated defect-free surface adjacent to the defect part grows over the defect part in an overhanging form. Therefore, the defect part having a length in minor axis thereof sufficiently shorter than twice the plating thickness is covered with the plated layer growing in the overhanging form, which is shaped like a dome, with the result that a surface of the plated layer becomes even. In contrast, the defect part having a length in minor axis thereof longer than twice the layer thickness of plated layer cannot be covered with even the plated layer grown in the overhanging form, with the result that the defect part remains as a pinhole and exposed on the surface of the plated layer. Further, even in the case where the length in minor axis of the defect part is around twice the layer thickness of the plated layer, if the defect part having a length in minor axis thereof longer than twice the layer thickness of the plated layer is covered with the dome-shaped overhang portion of the plated layer, the plated layer at center of the defect part is thin with low strength and therefore peeled off by the water washing process and the like cause, resulting in generation of a pinhole which exposes the defect part. When such a pinhole is formed, the pinhole becomes a starting point of development of corrosion caused by oxidation and moreover, a toner, a nitrogen oxide, etc. are more easily attached solidly to the corroded part which has fine irregularities, then causing unevenness in charging.

Further, the invention provides a charging apparatus mounted in an electrophotographic image forming apparatus including a photoreceptor to be opposite to a surface of the photoreceptor, the charging apparatus comprising:

a discharging electrode having a plurality of pointed protrusions, that applies voltage to the surface of the photoreceptor to charge the surface; and a grid electrode disposed between the discharging electrode and the photoreceptor, which is provided with a porous plate substrate and a polytetrafluoroethylene-containing nickel layer formed on an entirety or part of a surface of the porous plate substrate, wherein a length in minor axis of a secondary aggregate of polytetrafluoroethylene contained in the polytetrafluoroethylene-containing nickel layer is twice or less than a layer thickness of the polytetrafluoroethylene-containing nickel layer.

According to the invention, in the charging apparatus comprising the discharging electrode having the plurality of the pointed protrusions and the grid electrode provided with the porous plate substrate and the polytetrafluoroethylene-containing nickel layer (hereinafter referred to as "nickel-PTFE composite layer" unless particularly mentioned) formed on an entirety or part of a surface of the porous plate substrate, further the length in minor axis of the secondary aggregate of polytetrafluoroethylene contained in the nickel-PTFE composite layer is set at twice or less than the layer thickness of the nickel-PTFE composite layer. As a result, pinholes formed in a surface of the nickel-PTFE composite layer mainly attributable to fall of the PTFE secondary aggregate have almost no negative impact on the charge control performance of the grid electrode, thus leading significant enhancement in charge control performance of the grid electrode with respect to the surface of the photoreceptor. Accordingly, the charged potential of the surface of the photoreceptor is smoothly and stably controlled by the grid electrode so that the charged potential of the surface of the photoreceptor can be maintained within an appropriate range over a long period of time.

Further, the use of the grid electrode as described above allows the pointed protrusions of the discharging electrode to be more reliably free from foreign substances such as a toner. In particular, a widely-used toner (hereinafter referred to as "hydrophobic toner") adapted for increase in image forming speed, which contains hydrophobic silica as an external additive, is easily attached to the pointed protrusions of the discharging electrode, thus frequently causing gradual decrease in discharging performance of the discharging electrode. However, when the grid electrode having a structure described above is used, even the hydrophobic toner is prevented from being attached to the pointed protrusions of the discharging electrode so that the discharging performance of the needle electrode is stably maintained at a high level over a long period of time. Furthermore, the grid electrode is not a gold plated layer which is used in the related art, but an only nickel-PTFE composite layer formed on the surface of the grid substrate, resulting in an advantage of lower cost compared to the case of using the grid electrode of the related art. Accordingly, the image forming apparatus provided with the charging apparatus having the grid electrode as described above is capable of recording high-quality images over a long period of time without significant rise of production cost.

Reasons why excellent effects can be brought by the above-described configuration are speculated as follows. For example, a consideration is given to a case of employing electroless plating to form the nickel-PTFE composite layer. Since the plated layer growing by the electroless plating has no directional character, the nickel-PTFE composite layer grows so as to cover a surface of PTFE primary particle or PTFE secondary aggregate. However, the PTFE secondary aggregate having a length in minor axis thereof larger than twice the layer thickness of the nickel-PTFE composite layer, is exposed on the surface of the nickel-PTFE composite layer and then falls therefrom by a water washing process or the like cause, resulting in generation of a pinhole and decrease of PTFE content to thus reduce the PTFE's effect. Further, in the case where the length in minor axis of the secondary aggregate is close to twice the layer thickness of the nickel-PTFE composite layer, even the nickel-PTFE composite layer covering the surface of the secondary aggregate is thin in center part of the secondary aggregate and thus has low mechanical strength so that the PTFE-secondary aggregate easily falls by a water washing process or the like cause, resulting in generation of a pinhole which has a negative impact on the charge control performance of the grid electrode and resulting in decrease of PTFE content to thus reduce the PTFE's effect.

Further, in the invention, it is preferable that the polytetrafluoroethylene-containing nickel layer is formed on the grid electrode or a surface of the nickel layer formed on a surface of the grid electrode, and a length in minor axis of a defect part in the grid electrode or surface of the nickel layer coated with the polytetrafluoroethylene-containing nickel layer is twice or less than the layer thickness of the polytetrafluoroethylene-containing nickel layer.

According to the invention, the nickel-PTFE composite layer is formed on the grid electrode or the surface of the nickel layer formed on the surface of the grid electrode, and the length in minor axis of the defect part in the grid electrode or surface of the nickel layer coated with the nickel-PTFE composite layer is twice or less than the layer thickness of the polytetrafluoroethylene-containing nickel layer, in a consequence whereof the charge control performance of the grid electrode with respect to the surface of the photoreceptor is further enhanced, and the charge control performance of the grid electrode is not only enhanced but also maintained at high level over a long period of time. Accordingly, even in the case of continuous image formation at a high speed for many hours, the potential of the charged surface of the photoreceptor varies in a narrower range. As a result, even when making several hundred copies of one image, for example, it is possible to stably obtain images of which quality is constant or higher. Reasons why excellent effects can be brought by the above-described configuration are speculated as in the case of the discharging electrode.

Further, in the invention, it is preferable that the polytetrafluoroethylene-containing nickel layer is formed by an electroless plating method.

According to the invention, the nickel-PTFE composite layer of the discharging electrode or grid electrode is formed by the electroless plating method. Compared to the nickel-PTFE composite layer obtained by a normal electrolytic plating method using DC electricity, the nickel-PTFE composite layer obtained by the electroless plating method has a dense and hard structure with less pinholes, of which layer is thin and nevertheless uniform, and has high adhesiveness to the discharging electrode substrate, leading further enhancement of the corona discharging performance of the discharging electrode, and controllability for the charged potential and durability of the grid electrode. Furthermore, the hydrophobic toner is prevented from being attached to the discharging electrode. When the electroless plating method is employed, it is also easy to set a particle diameter of the PTFE secondary aggregate contained in the nickel-PTFE composite layer within the above-stated defined range by selecting plating conditions.

Further, in the invention, it is preferable that a diameter of primary particle of polytetrafluoroethylene contained in the polytetrafluoroethylene-containing nickel layer is 0.7 μm or more.

According to the invention, the diameter of primary particle of polytetrafluoroethylene contained in the nickel-PTFE composite layer is set at 0.7 μm or more, thereby preventing generation of pinholes attributable to fall of the PTFE primary particle and/or PTFE secondary aggregate from the surface of the nickel-PTFE composite layer. Accordingly, the corona discharging performance of the discharging electrode, the charge control performance of the grid electrode with respect to the surface of the photoreceptor and the durability of the grid electrode are further enhanced and moreover, the unevenness of the corona discharging performance becomes very small, thus leading very smaller unevenness in the charged potential of the surface of the photoreceptor. As a result, the charged potential of the surface of the photoreceptor is stable at any time, and even in continuous image formation onto several hundred sheets or more, it is possible to obtain high-quality images of which image quality is not varied.

Further, in the invention, it is preferable that a layer thickness of the polytetrafluoroethylene-containing nickel layer is larger than the diameter of primary particle of polytetrafluoroethylene.

According to the invention, the nickel-PTFE composite layer is formed so that a layer thickness thereof is larger than the diameter of PTFE primary particle, thereby further preventing generation of pinholes attributable to fall of the PTFE primary particle and/or PTFE secondary aggregate from the surface of the nickel-PTFE composite layer. Accordingly, the corona discharging performance of the discharging electrode and the charge control performance of the grid electrode with respect to the surface of the photoreceptor are further enhanced and moreover, the unevenness of the corona discharging performance is further reduced, thus leading further reduction of unevenness in the charged potential of the surface of the photoreceptor. As a result, the charged potential of the surface of the photoreceptor is stable at any time, and even in continuous image formation onto several hundred sheets or more, it is possible to obtain high-quality images of which image quality is not varied.

Further, in the invention, it is preferable that a nickel plated layer is further formed between the discharging electrode and the polytetrafluoroethylene-containing nickel layer.

Further, in the invention, it is preferable that a nickel plated layer is further formed between the porous plate substrate and the polytetrafluoroethylene-containing nickel layer.

According to the invention, a nickel plated layer is formed between the discharging electrode or porous plate substrate and the nickel-PTFE composite layer, with the result that the nickel-PTFE composite layer is reliably prevented from being peeled off from the discharging electrode so that a long-term durability of the discharging electrode is further enhanced. Accordingly, it is possible to obtain a charging apparatus which can stably control the charged potential of the surface of the photoreceptor over a longer period of time.

Further, in the invention, it is preferable that the polytetrafluoroethylene-containing nickel layer contains phosphorus together with nickel.

According to the invention, the nickel-PTFE composite layer contains phosphorus together with nickel and PTFE, with the result that the layer has enhanced adhesiveness to the discharging electrode or porous plate substrate, and thus the discharging electrode or the grid electrode has further enhanced durability.

Further, in the invention, it is preferable that the porous plate substrate is a porous stainless steel plate or a porous copper plate.

According to the invention, the porous stainless steel plate and the porous copper plate are preferably used as the porous plate substrate. When the porous stainless steel plate is used, the controllability of the charged potential of the surface of the photoreceptor is very favorable and moreover, the corrosion represented by generation of rust less frequently occurs and an amount of attachment of nitrogen oxide is extremely small, resulting in further higher durability. On the other hand, the porous copper plate is inexpensive but involves a drawback of insufficient corrosion resistance. The insufficient corrosion resistance of the porous copper plate is, however, enhanced to a satisfactory level by forming the nickel-PTFE composite layer. In addition, the porous copper plate has very favorable adhesiveness to the nickel-PTFE composite layer, thus causing no need to form the nickel layer between the porous copper plate and the nickel-PTFE composite layer, in a consequence whereof the number of manufacturing steps can be decreased to thus reduce the production cost. Accordingly, when the porous copper plate is used, it is possible to obtain a grid electrode which less frequently suffers from the corrosion represented by generation of rust and has a smaller amount of attachment of nitrogen oxide, excellent durability, and favorable controllability of the charged potential of the surface of the photoreceptor and moreover which is inexpensive.

Further, the invention provides an image forming apparatus comprising:

a photoreceptor on a surface of which an electrostatic latent image is formed;

a charging section for charging the surface of the photoreceptor;

an exposure section that irradiates a charged surface of the photoreceptor with signal light which is based on image information to thereby form the electrostatic latent image;

a developing section that supplies a toner to the electrostatic latent image on the surface of the photoreceptor to thereby form a toner image;

a transfer section that transfers the toner image onto a recording material; and a fixing section that fixes the toner image transferred on the recording material, wherein the charging section is the above-described charging apparatus.

According to the invention, in the image forming apparatus composed of the photoreceptor, the charging section, the exposure section, the developing section, the transfer section, and the fixing section, there is used the charging apparatus of the invention which is made by forming the nickel-PTFE composite layer having the above-described structure on at least one surface of the discharging electrode, or alternatively, there is used the charging apparatus of the invention having the grid electrode which is made by forming the nickel-PTFE composite layer on the surface of the porous plate substrate, with the result that the charged potential of the surface of the photoreceptor can be maintained within an appropriate range during formation of the electrostatic latent images, thus allowing record of high-quality images over a long period of time, and moreover there is no gold plated layer which is contained in the related art, thus realizing an image forming apparatus at lower cost.

Further, in the invention, it is preferable that a toner contains hydrophobic silica as an external additive.

According to the invention, the use of the hydrophobic toner in the image forming apparatus of the invention allows increase of image forming speed without impairing the corona discharging performance of the discharging electrode in the charging apparatus over a long period of time.

Further, in the invention, it is preferable that the image forming apparatus further comprises a cleaning section that removes a toner remaining on the surface of the photoreceptor after the toner image has been transferred onto the recording material, wherein the charging section is disposed vertically below the developing section or the cleaning section.

According to the invention, in the case where the image forming apparatus further comprises the cleaning section that removes the toner remaining on the surface of the photoreceptor, the charging section is disposed vertically below the developing section or the cleaning section, with the result that the number of charging defects generated in the surface of the photoreceptor is significantly reduced. For example, when the charging section is disposed vertically above both of the developing section and the cleaning section, the charging defect is liable to arise in the photoreceptor.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
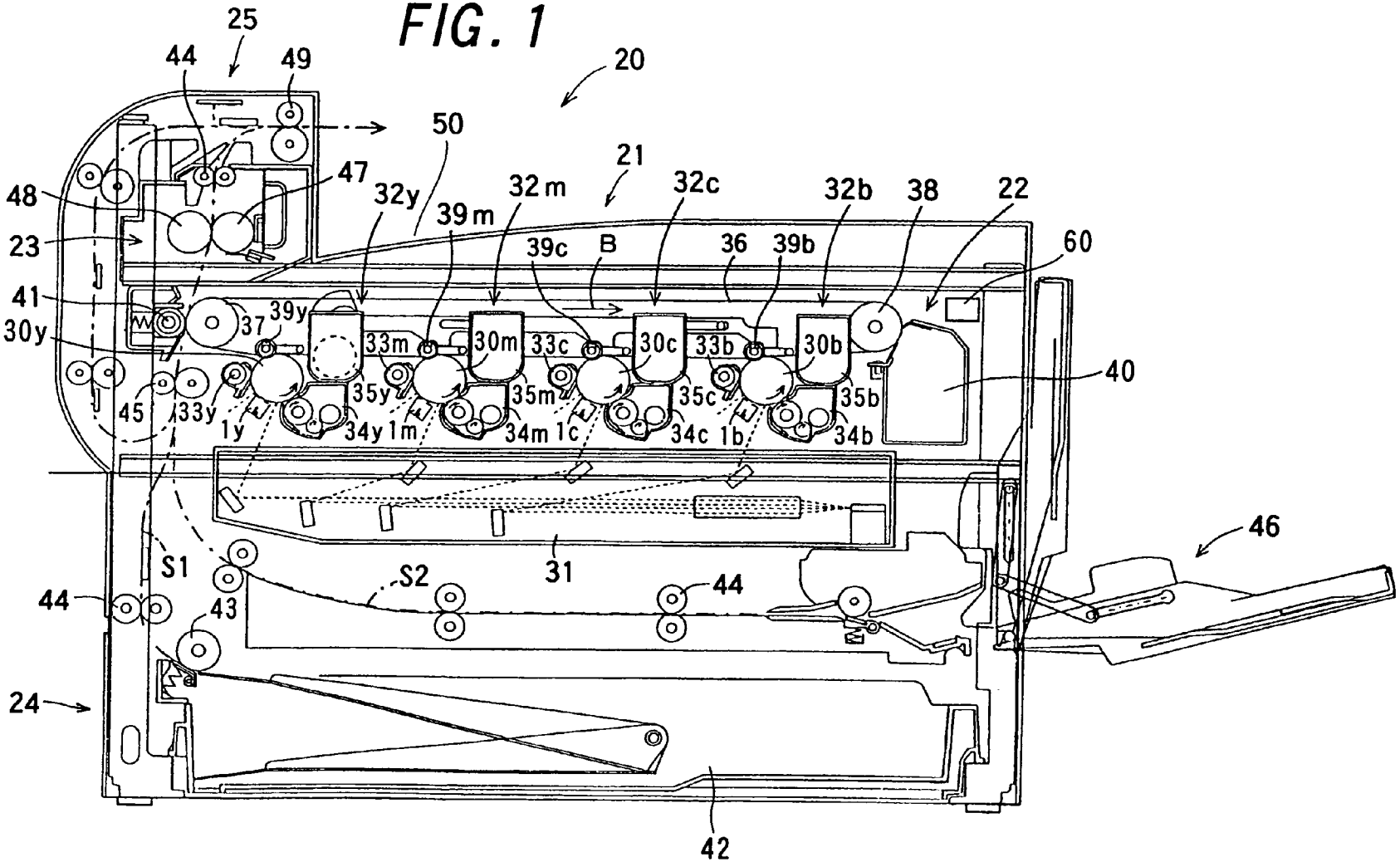
FIG. 1 is a sectional view schematically showing a configuration of an image forming apparatus according to one embodiment of the invention.

Now referring to the drawings, preferred embodiments of the invention are described below.

FIG. 1 is a sectional view schematically showing a configuration of an image forming apparatus 20 according to one embodiment of the invention. An image forming apparatus 20 is a multifunctional machine having a copier function, a printer function, and a facsimile function together, and according to image information being conveyed to the image forming apparatus 20, a full-color or monochrome image is formed on a recording medium such as a recording sheet. That is, the image forming apparatus 20 has three types of printer mode, i.e., a copier mode, a printer mode and a FAX mode, and the printer mode is selected by a control unit 60 depending on, for example, the operation input from an operation portion (not shown) and reception of the printing job from an external host apparatus such as a personal computer. The image forming apparatus 20 comprises a toner image forming section 21, a transfer section 22, a fixing section 23, a recording medium supply section 24, and a discharge section 25. In accordance with image information of respective colors of black (b), cyan (c), magenta (m), and yellow (y) which are contained in color image information, there are provided respectively four sets of the components constituting the toner image forming section 21 and a part of the components contained in the transfer section 22. The four sets of respective components provided for the respective colors are distinguished herein by giving alphabets indicating the respective colors to the end of the reference numerals, and in the case where the sets are collectively referred to, only the reference numerals are shown.

The toner image forming section 21 comprises a photoreceptor drum 30, a charging apparatus 1, an exposure unit 31, a developing section 32, and a cleaning unit 33. The charging apparatus 1, the developing section 32, and the cleaning unit 33 are disposed in this order around the photoreceptor drum 30 toward downstream in a rotational direction of the photoreceptor drum 30. The charging apparatus 1 is disposed vertically below the cleaning unit 33.

The photoreceptor drum 30 is rotatably supported around an axis thereof by a driving mechanism (not shown), and includes a conductive substrate and a photosensitive layer formed on a surface of the conductive substrate. The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film obtained by forming a conductive layer containing one or two or more of aluminum, aluminum alloy, tin oxide, gold, indium oxide, etc. on a film-like substrate such as of synthetic resin film, metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. Provision of the undercoat layer offers advantages such as covering the flaws and irregularities present on the surface of the conductive substrate to thereby smooth the surface of the photosensitive layer, preventing degradation of the chargeability of the photosensitive layer during repetitive use, and enhancing the charging property of the photosensitive layer under a low temperature and/or low humidity circumstance.

The charge generating layer contains as a main ingredient a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generation ability and are suitable for obtaining a light sensitive layer at high sensitivity. The charge generating substance can be used alone or two or more of the materials can be used in combination. The content of the charge generating substance is, without a particular restriction, preferably from 5 to 500 parts by weight and more preferably from 10 to 200 parts by weight, based on 100 parts by weight of binder resin in the charge generating layer.

Also as the binder resin for charge generating layer, materials used customarily in the relevant field can be used including, for example, melamine resin, epoxy resin, silicone resin, polyurethane, acryl resin, vinyl chloride-vinyl acetate copolymer resin, polycarbonate, phenoxy resin, polyvinyl butyral, polyallylate, polyamide, and polyester. The binder resin can be used alone or, optionally, two or more of the resins can be used in combination.

The charge generating layer can be formed by dissolving or dispersing an appropriate amount of a charge generating substance, binder resin and, optionally, a plasticizer, a sensitizer, etc. respectively in an appropriate organic solvent which is capable of dissolving or dispersing the ingredients described above, to thereby prepare a coating solution for charge generating layer, and then applying the coating solution for charge generating layer to the surface of a conductive substrate, followed by drying. The thickness of the charge generating layer obtained in this way is, without a particular restriction, preferably from 0.05 to 5 μm and more preferably from 0.1 to 2.5 μm.

The charge transporting layer stacked over the charge generating layer contains as an essential ingredient a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiopnene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, promanyl, chloranyl, and benzoquinone. The charge transporting substance can be used alone or two or more of the materials can be used in combination. The content of the charge transporting substance is, without a particular restriction, preferably from 10 to 300 parts by weight and more preferably from 30 to 150 parts by weight based on 100 parts by weight of the binder resin in the charge transporting substance.

As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resins thereof. Among those materials, in view of the film forming property, and the wear resistance, electrical characteristics etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resin can be used alone or two or more of the resins can be used in combination.

The charge transporting layer preferably contains an antioxidant together with the charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane and derivatives thereof, an organic sulfur compound, an organic phosphorus compound. The antioxidant can be used alone or two or more of the antioxidants can be used in combination. The content of the antioxidant is, without a particular restriction, from 0.01 to 10% by weight and preferably from 0.05 to 5% by weight based on the total amount of the ingredients constituting the charge transporting layer.

The charge transporting layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is, without a particular restriction, preferably from 10 to 50 μm and more preferably from 15 to 40 μm.

Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer. In the embodiment, as described above, there is used a photoreceptor drum which has an organic photosensitive layer using the charge generating substance and the charge transporting substance. It is, however, also possible to use, instead of the above photoreceptor drum, a photoreceptor drum which has an inorganic photosensitive layer using silicon or the like.

Figure 2:
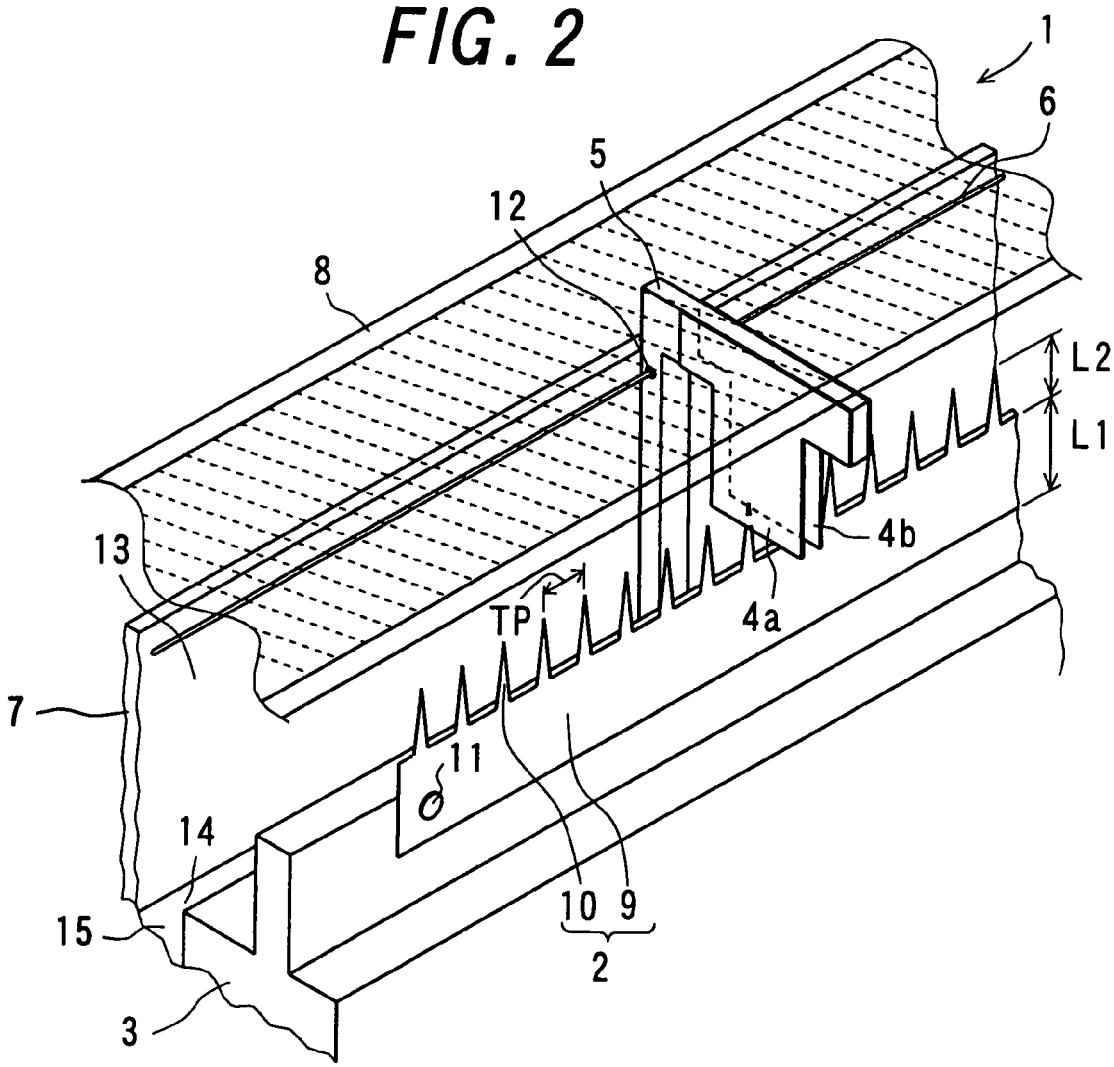
FIG. 2 is a perspective view schematically showing a basic configuration of a charging apparatus used in the image forming apparatus according to the one embodiment of the invention.
Figure 3:
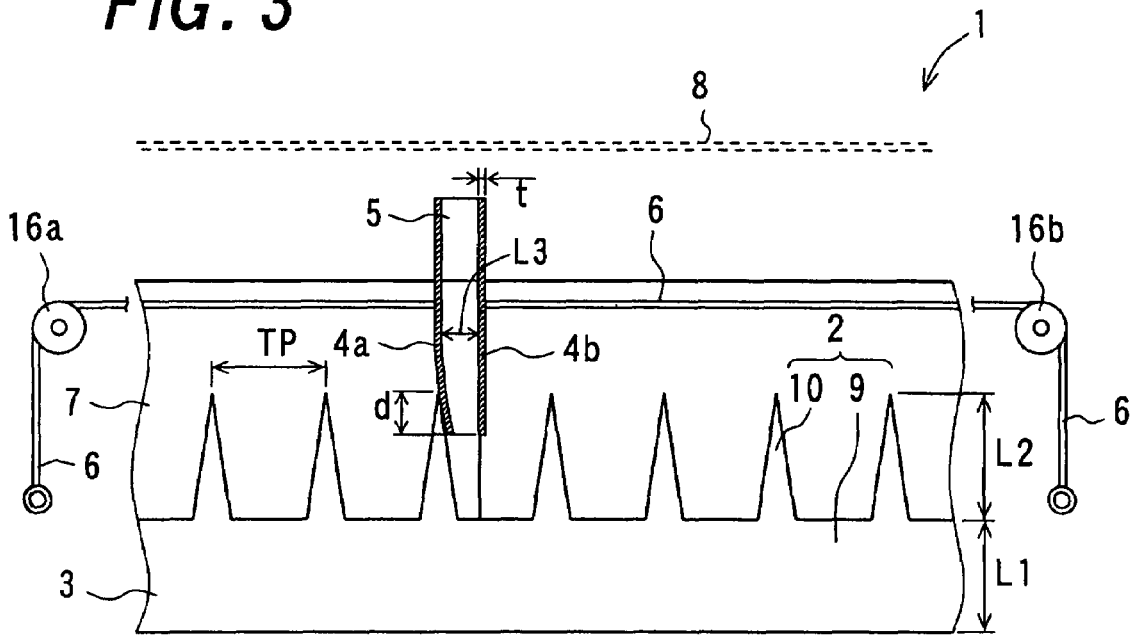
FIG. 3 is a front view of the charging apparatus shown in FIG. 2.

The charging apparatus 1 being used is the charging apparatus 1 shown in FIG. 2 and FIG. 3. The charging apparatus 1 is disposed along a longitudinal direction of the photoreceptor drum 30 so that the charging apparatus 1 faces the photoreceptor drum 30. FIG. 2 is a perspective view schematically showing a basic configuration of the charging apparatus 1 according to a first embodiment of the invention. FIG. 3 is a front view of the charging apparatus 1 shown in FIG. 2. In the image forming section 21, the charging apparatus 1 is disposed along a longitudinal direction of the photoreceptor drum 30 so as to face the photoreceptor drum 30. The charging apparatus 1 includes: a discharging electrode 2 having a plurality of pointed protrusions 10 (hereinafter referred to as "needle electrode 2"); a holding member 3; two cleaner members 4*a* and 4*b*; a support member 5; a moving member 6; a shield case 7; and a grid electrode 8. Note that, as well as the developing section 32, the cleaning unit 33, and the like component, the charging apparatus 1 is disposed around the photoreceptor drum 30 while the charging apparatus 1 is preferably disposed vertically below either or both of the developing section 32 and the cleaning unit 33 in the image forming apparatus 20 in order to reliably prevent the charging defects from occurring mainly on the photoreceptor drum 30. In the present embodiment, the charging apparatus 1 is disposed vertically below the cleaning unit 33.

The needle electrode 2 is a thin plate member composed of a flat plate 9 and the pointed protrusions 10. The flat plate 9 is formed so as to extend long in one direction. The pointed protrusion 10 is formed so as to transversely protrude from one end face in a transverse direction of the flat plate 9. The needle electrode 2 is made of, for example, stainless steel. In the embodiment, a length L1 in the transverse direction of the flat plate 9 is 10 mm while a length L2 in the protruding direction of the pointed protrusion 10 is 2 mm, a radius of curvature R at a top of the pointed protrusion 10 is 40 μm, and a pitch TP at which the protrusions 10 are formed is 2 mm. To the needle electrode 2 is connected a power source (not shown). Voltage application from the power source to the needle electrode 2 causes the pointed protrusion 10 to conduct the corona discharge toward the surface of the photoreceptor drum 30 so that the surface of the photoreceptor drum 30 is charged. In the embodiment, a voltage of 5 kV is applied to the needle electrode 2.

Figure 4:
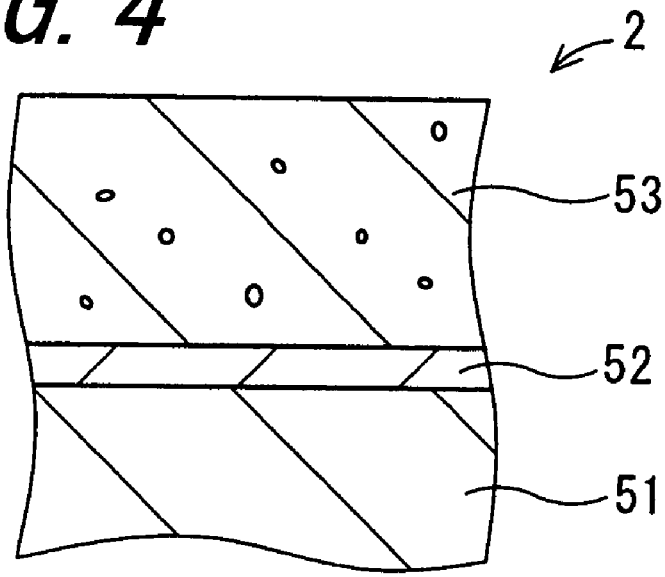
FIG. 4 is a sectional view schematically showing a configuration of a discharging electrode used in the charging apparatus according to a first embodiment of the invention.

In the charging apparatus 1 according to the first embodiment of the invention, a nickel-PTFE composite layer 53 is formed on at least one surface of the needle electrode 2 as shown in FIG. 4. The nickel-PTFE composite layer 53 is a surface coating layer which is formed by dispersing PTFE primary particles and/or PTFE secondary agglomerated particles in a nickel layer. In some cases, the PTFE primary particles and/or PTFE secondary aggregates are exposed on a surface of the nickel-PTFE composite layer 53. The inventor's study has revealed that, when these particles and/or aggregates fall off the surface of the nickel-PTFE composite layer 53, pinholes are generated in the surface, with the result that an electrode undercoat layer (discharging electrode substrate) 51 of the needle electrode 2 may be exposed. The exposure of the electrode undercoat layer 51 causes the corona discharging performance of the needle electrode 2 to be decreased or causes unevenness in the charged potential of the surface of the photoreceptor drum 30. In view of such a problem, in the invention, a length in minor axis of the PTFE secondary aggregate contained in the nickel-PTFE composite layer 53 is set at twice or less than a layer thickness of the nickel-PTFE composite layer, preferably at equal to or less than the layer thickness of the nickel-PTFE composite layer, whereby the electrode undercoat layer 51 is prevented from being exposed, thus resulting in the needle electrode 2 which exhibits high corona discharging performance stably over a long period of time and by which the surface of the photoreceptor is less unevenly charged.

In the case where the length in minor axis of the PTFE secondary aggregate contained in the nickel-PTFE composite layer 53 becomes larger than twice the layer thickness of the nickel-PTFE composite layer 53, a larger amount of the PTFE secondary aggregate falls off, thus leading an increase in number of the pinholes which expose the electrode undercoat layer 51. As a result, the corona discharging performance of the needle electrode 2 becomes more easily uneven. Thus, the potential of the charged surface of the photoreceptor drum 30 may be insufficiently equalized.

Further, the layer thickness of the nickel-PTFE composite layer 53 is preferably larger than a particle diameter of the PTFE primary particle. A preferable particle diameter of the PTFE primary particle contained in the nickel-PTFE composite layer 53 is 0.7 μm or more. Since the nickel-PTFE composite layer 53 contains the PTFE primary particles and the PTFE secondary aggregates as described above, the particle diameter of the PTFE is preferably set so that the diameter of the primary particle is 0.7 μm or more while the length in minor axis of the PTFE secondary aggregate is twice or less than the layer thickness of the nickel-PTFE composite layer 53. Herein, the PTFE secondary aggregates are particles formed of a plurality of aggregated PTFE primary particles and thus may be referred to as the PTFE secondary aggregate particles. Further, the length in minor axis of the PTFE secondary aggregate can be obtained by observation of the surface of the nickel-PTFE composite layer 53 through a scanning electron microscope (abbreviated as SEM, trade name: Real Surface View Microscope) manufactured by Keyence Corporation. That is to say, by using the scanning electron microscope, the surface of the nickel-PTFE composite layer 53 is observed at 500-fold magnification to check whether or not the PTFE secondary aggregate is present in one field, and in the case where the PTFE secondary aggregate is found, the magnification is adjusted to 3,000 so that the length in minor axis of the PTFE secondary aggregate is measured. The length in minor axis indicates the narrowest part of the PTFE secondary aggregate. The observation described above is repeated in 20 fields to then obtain an average thereof which is defined as the length in minor axis of the PTFE secondary aggregate.

The needle electrode 2 can be manufactured in accordance with a heretofore known method. One example of the method is a manufacturing method including a chemical polishing step, a water washing step, an acid dipping step, a water washing step, a pure water dipping step, a nickel plating step, a nickel-PTFE composite plating step, a water washing process, and a drying process. Among those steps, the nickel plating step is not an essential step, but optionally carried out. At the chemical polishing step, masking and etching are performed on a plate metal. The masking can be conducted in accordance with a heretofore known method. The etching can also be conducted in accordance with a heretofore known method, which includes, for example, a method of spraying an etching solution such as an aqueous solution of ferric chloride to the plate metal. As the metal for the material of the plate metal, it is possible to use a material which generates the corona discharge when voltage is applied thereto. Examples of the material include stainless steel, aluminum, nickel, copper and iron. Among those metals, stainless steel is particularly preferred from the aspect of enhancement in durability of the needle electrode 2. Specific examples of the stainless steel include, for example, SUS304, SUS309 and SUS316. Among those stainless steels, SUS304 is preferred. Further, copper is particularly preferred from the aspect of enhancement in adhesiveness to the nickel-PTFE composite layer 53, reduction in production cost, etc. In the case where copper is used, a nickel plated layer 52 does not have to be formed because of very high adhesiveness of copper to the nickel-PTFE composite layer 53. A thickness of the plate metal is, without a particular restriction, preferably from 0.05 to 1 mm and more preferably from 0.05 to 0.3 mm.

The plate metal in which the plurality of pointed protrusions are formed at the chemical polishing step, is treated with water washing, acid cleaning or pure water cleaning at the water washing step, the acid dipping step, the water washing step, and the pure water dipping step, whereby obstacles are removed form the surface so that the discharging electrode substrate 51 is obtained. Note that the surface of the discharging electrode substrate 51 may contain defect parts such as a recess formed by contact with other objects and a part on which a chemical substance, an oxide film, and the like material used for the etching, masking, etc. are deposited and remain. A length in minor axis of the defect part thus described is preferably twice or less than the layer thickness of the nickel-PTFE composite layer formed at the later-described nickel-PTFE composite plating step. The length in minor axis of the defect part means the narrowest width of the defect part when the defect part is observed at 3,000-fold magnification through the scanning electron microscope (Real Surface View Microscope). In order to set the length in minor axis of the defect part in a predetermined range, it is only necessary to repeat the water washing, the acid cleaning, the pure water cleaning, etc. Such a configuration further enhances the corona discharging performance of the final needle electrode.

Although the nickel plating step is not an essential step as described above, it is preferable to conduct the step in order to enhance adhesiveness of the nickel-PTFE composite layer 53 to the discharging electrode substrate 51. The nickel plating may be conducted in accordance with a commonly-used method, but preferably electroplated in consideration of the following formation of the nickel-PTFE composite layer 53. Further, the layer thickness of the nickel plated layer 52 formed by means of the nickel plating is, without a particular restriction, preferably 0.03 to 3 μm, more preferably 0.5 to 1.5 μm, and particularly preferably about 1 μm. Note that as in the case of the surface of the needle electrode substrate 51, the surface of the nickel plated layer 52 may contain defect parts such as a recess and a part on which a chemical substance, an oxide film, and the like material are deposited. Also in the surface of the nickel plated layer 52, a length in minor axis of the defect part is preferably twice or less than the layer thickness of the nickel-PTFE composite layer 53 formed at the later-described nickel-PTFE composite plating step. In order to set the length in minor axis of the defect part within a predetermined range, it is only necessary to repeat the water washing, the acid cleaning, the pure water cleaning, etc. Such a configuration further enhances the corona discharging performance of the final needle electrode.

The nickel-PTFE composite plating step can be conducted in accordance with an electroless nickel plating method including a catalytic nickel plating method (Kanigen process). A plating bath for use in the electroless nickel plating method is prepared, for example, by adding polytetrafluoroethylene to an aqueous solution containing hypophosphorous acid or salt thereof and nickel salt. The plating bath is usually adjusted so that its pH falls in a range from 5 to 5.5. Polytetrafluoroethylene being used in this case is particulate polytetrafluoroethylene of which particle diameter is not particularly restricted as long as being smaller than a thickness of plated layer to be formed, and is preferably 1 μm or less and more preferably 100 to 500 nm. An addition amount of polytetrafluoroethylene to the plating bath is not particularly restricted either, and preferably 0.01% to 10% by weight or more preferably 0.1% to 1.0% by weight based on a total weight of the plating bath. Specific examples of the plating bath include "KANIFLON S" (trade name) manufactured by Japan Kanigen Co., Ltd., "NIMUFLON" (trade name) manufactured by C. Uemura & Co., Ltd., and "TOP NICOSITE" series (trade name) manufactured by Okuno Chemical Industries Co., Ltd.

The discharging electrode substrate 51 is dipped into the plating bath having the composition and pH as described above so that the electroless nickel plating is carried out, whereby the nickel-PTFE composite layer 53 is formed on the surface of the substrate. A PTFE content in the nickel-PTFE composite layer 53 thus formed is preferably 3% to 30% by volume and more preferably 10% to 20% by volume. A layer thickness of the nickel-PTFE composite layer 53 thus formed is not particularly restricted, and is preferably equal to or more than a particle diameter of the PTFE particle, more preferably twice as large as the particle diameter of the PTFE particle to 20 μm, and particularly preferably twice as large as the particle diameter of the PTFE particle to 10 μm. In the nickel-PTFE composite layer 53 of which thickness is less than the particle diameter of the PTFE particle, there are easily generated pinholes by fall of a PTFE particle-sized part of the nickel-PTFE composite layer 53. As a result, the nickel-PTFE composite layer 53 becomes uneven, and the discharging electrode substrate 51 easily corrodes at the pinholes, thereby causing the charged potential of the photoreceptor to be liable to become partially unstable. On the other hand, in the nickel-PTFE composite layer 53 of which thickness largely exceeds 20 μm, a plating film may possible be peeled off due to stress. Note that the thickness of the nickel-PFTE composite layer 53 is substantially proportional to a length of the plating time and therefore, it is only necessary to appropriately change a length of dipping time of the discharging electrode substrate 51 into the plating bath in order to obtain a desired layer thickness.

Since a liquid agent contained in the plating bath is deposited uniformly on the surface of the discharging electrode substrate 51, the nickel-PTFE composite layer 53 formed by the electroless plating has a favorable characteristic that the layer is uniform with no variation in thickness even in the case where the layer is so thin as about the particle diameter of the PTFE particle. Further, the plating structure is dense and has high adhesiveness to the surface of the discharging electrode substrate 51 and even when used for a long time, no peeling or the like is caused.

At the nickel-PTFE composite plating step, in order to obtain the nickel-PTFE composite layer 53 defined in the invention, it is only necessary to appropriately change the content (% by volume) of the PTFE particles, the bath temperature of the plating bath, the plating time, and the other plating conditions. For example, the plating bath is depressurized shortly before the plating process to expel oxygen or the like gas which is dissolved in the plating bath, to thereby prevent bubbles from arising in the plating bath during the plating process and moreover, the bath temperature of the plating bath is maintained to be in a range from 90° C. to 92° C. while the plating time is set at 5 to 60 minutes. Other than the depressurizing process, an applicable degassing process is ultrasonic vibration or stirring for a predetermined length of time at the bath temperature during the plating process. Further, the nickel-PTFE composite plating step can be conducted by electroplating. In the electroplating, it is possible to use the same plating bath as that used in the electroless plating. The conditions for the electroplating are the same as those set for general nickel electroplating. The nickel-PTFE composite plating using the electroplating exhibits an electroplating-specific tendency, that is, a tendency that an edge part is easily plated while a part of a porous plate grid substrate where a through hole is formed is hard to be plated. Accordingly, in order to make the layer thickness of the plated layer uniform, it is necessary to increase the layer thickness preferably to 3 μm or more. Note that, upon forming the nickel-PTFE composite layer 53, either of the electroless plating and the electroplating may be selected according to features and costs of respective plating methods.

The holding member 3 is a member which extends long in one direction like the needle electrode 2, and of which cross section in perpendicular to the longitudinal direction has an inverted T shape. The holding member 3 holds the needle electrode 2. The holding member 3 is formed of synthetic resin, for example. The needle electrode 2 is screwed by thread members 11 at near both ends in the longitudinal direction of the needle electrode 2 onto one lateral side of a protruded portion of the holding member 3.

The cleaner members 4*a* and 4*b* are platy members which are movable relative to the needle electrode 2 and upon moving, frictionally rubs the needle electrode 2 to thereby clean the surface of the needle electrode 2. In more detail, each of the cleaner members 4*a* and 4*b* has a T-shaped configuration when projected on a plane, and is made of an elastic body of a metal material or a polymeric material with a thickness t of from 20 to 40 μm. In the case where the thickness t is less than 20 μm, the member is easily deformed upon abutting against the needle electrode 2, but a reaction force accompanied by the deformation, i.e., the pressing force to the needle electrode 2, is small, with the result that contaminants deposited on the needle electrode 2 cannot be removed sufficiently. In the case where the thickness t exceeds 40 μm, the contaminants deposited on the needle electrode 2 can be removed sufficiently, but higher stiffness excessively increases the pressing force to the needle electrode 2, with the result that the tip of the protrusion 10 of the needle electrode 2 may possibly be fractured by the deformation. As a result, in the case where the thickness t is out of the range of 20 to 40 μm, image unevenness etc. due to the charging defect may possible be caused.

As the metal material constituting the cleaner members 4*a* and 4*b*, phosphor bronze, ordinary steel, stainless steel, etc. can be used. Among these metal materials, stainless steel is preferred from a viewpoint of the duration life based on anti-oxidation property while considering that the cleaner members 4*a* and 4*b* are used in the atmosphere of ozone generated by corona discharge. As stainless steel, heretofore known stainless steel can be used including, for example, austenitic stainless steel, i.e. SUS304 and ferritic stainless steel, i.e. SUS430, which are defined by Japanese Industrial Standard (JIS) G4305.

The cleaner members 4*a* and 4*b* are disposed so as to have a gap L3 therebetween when viewed in their moving direction relative to the needle electrode 2. The gap L3 is selected to have a distance such that when one cleaner member 4*a* is deformed upon abutting against the needle electrode 2, the other cleaner member 4*b* is not in contact with the deformed member 4*a*, and this is adjustable by the thickness of the beam portion of the support member 5 to which the cleaner members 4*a* and 4*b* are attached. Since a deformation state of the cleaner members 4*a* and 4*b* changes depending on the material thereof, the gap L3 is preferably determined by a previous testing of the deformation state of the material. In the case where each of the cleaner members 4*a* and 4*b* is made, for example, of stainless steel at a thickness t of 30 μm, the gap L3 is preferably 2 mm. By virtue of the gap L3 provided between the two cleaner members 4*a* and 4*b*, while one cleaner member 4*a* frictionally rubs the needle electrode 2, the other cleaner member 4*b* does not hinder the deformation of one cleaner member 4*a* so that the pressing force is maintained within a preferred range. As a result, the needle electrode 2 can be cleaned sufficiently without causing deformation damage on the top end thereof.

The hardness of the cleaner member 4*a* and 4*b* is preferably 115 or more by Rockwell hardness M scale according to American Society for Testing and Materials (ASTM) Standards D785. In the case where the Rockwell hardness is less than 115, the material is excessively soft and therefore, the cleaner members 4*a* and 4*b* are deformed excessively than required when abutting on and frictionally rubbing the needle electrode 2, thus failing to obtain the cleaning effect. Since the high hardness of the cleaner members 4*a* and 4*b* causes no particular problem in function thereof, it is not necessary to define the upper limit. However, the upper limit, if defined, is 130 since the upper limit value in the Rockwell hardness M scale is 130.

A lateral size w of the longitudinal rod portion of the T-shape of the cleaner members 4*a* and 4*b*, which is a portion abutting against the needle electrode 2, that is to say, the size w of the cleaner members 4*a* and 4*b* in the direction vertical to the moving direction of the cleaner members 4*a* and 4*b* and in the direction vertical to the extending direction of the protrusion 10, is preferably 3.5 mm or more. In the case where the lateral size w is smaller than 3.5 mm, the value of a force per unit area generated upon deformation when pressed by the needle electrode 2 is large, and it therefore becomes easier to cause fatigue fracture due to the repetitive deformation, resulting in decrease in length of the duration life. The value of the force per unit area described above can be decreased to extend the duration life against the repetitive deformation by making the lateral size w to 3.5 mm or more. However, the excessively increased width makes the stiffness too high and the size of the device too large, and it is therefore preferable to set the upper limit to about 10 mm.

The cleaner members 4*a* and 4*b* and the needle electrode 2 are preferably arranged such that an intrusion amount d of the protrusion 10 of the needle electrode 2 to the cleaner members 4*a* and 4*b* is from 0.2 to 0.8 mm. The intrusion amount d means an overlap length between the cleaner members 4*a* and 4*b* and the protrusion 10 in the extending direction of the protrusion 10 in a state where the cleaner members 4*a* and 4*b* and the protrusion 10 are projected upon a virtual plane perpendicular to a moving direction of the cleaning members 4*a* and 4*b* relative to the needle electrode 2. In the case where the intrusion amount d is less than 0.2 mm, a reaction force accompanied by the deformation, i.e., the pressing force to the needle electrode 2, is small, with the result that contaminants deposited on the needle electrode 2 cannot be removed sufficiently. In the case where the intrusion amount d exceeds 0.8 mm, the contaminants deposited on the needle electrode 2 can be removed sufficiently, but the reaction force accompanied by the deformation (i.e. the pressing force to the needle electrode 2) is too large, with the result that the tip of the protrusion 10 of the needle electrode 2 may possibly be fractured by the deformation. As a result, in the case where the intrusion amount d is out of the range from 0.2 to 0.8 mm, image unevenness etc. due to the charging defect may possibly be caused.

The support member 5 is a member having an inverted L-shaped configuration for supporting the cleaner members 4*a* and 4*b*. To a beam portion of the support members 5 are attached arm portions of the cleaner members 4*a* and 4*b* in the T-shaped configuration. The columnar portion of the support member 5 has a through hole 12 therein, which extends in parallel with the extending direction of the needle electrode 2 and through which the moving member 6 is inserted. Since the moving member 6 is fixed to the support member 5 at a portion where the moving member 6 is inserted through the through hole 12, traction of the moving member 6 in the extending direction of the needle electrode 2 makes the support member 5 move slidably with respect to the groove 14 so that the support member 5 is guided by the groove portion 14 to be thereby allowed to move in the extending direction of the needle electrode 2. That is to say, the cleaner members 4*a* and 4*b* supported by the support member 5 can be made to abut on and frictionally rub the needle electrode 2. The moving member 6 is a thread-like or wire-like member, which is inserted through the through hole 12 formed in the columnar portion of the support member 5 and thus provided in parallel with the extending direction of the needle electrode 2. The moving member 6 extends from a hole or gap formed in the later-described shield case 7 to outside of the shield case 7 so that an end of the moving member 6 is suspended by way of an outer surface of the shield case 7 or by way of pulleys 16*a* and 16*b* disposed on a machine body of the image forming apparatus 20. The pulleys 16*a* and 16*b* and the end of the moving member 6 are not shown in FIG. 2.

The end of the moving member 6 preferably extends as far as the outside of the machine body of the image forming apparatus 20. This enables to clean the needle electrode 2 without detaching the charging apparatus 1 from the image forming apparatus 20 or without opening the image forming apparatus 20. When cleaning is conducted by making the cleaner members 4*a* and 4*b* abut on the needle electrode 2 by means of traction of the moving member 6, the pressing force of the cleaner members 4*a* and 4*b* against the needle electrode 2 is adjusted preferably to 10 to 30 gf. In the case where the pressing force is less than 10 gf, contaminants such as a toner or paper dust deposited on the needle electrode 2 cannot possibly be removed sufficiently and, on the other hand, in the case where the pressing force exceeds 30 gf, the top end of the protrusion 10 of the needle electrode 2 may possibly be fractured by deformation. Further, the pressing force of the cleaner members 4*a* and 4*b* against the needle electrode 2 can be adjusted by the moving member 6. The force loaded on the cleaner member 4*a* or 4*b* is measured in a state where a weight is suspended from one end of the moving member 6. Measurement is conducted, for example, by connecting a spring balance to the cleaner member 4*a* or 4*b*. Then, by selecting a weight to provide a force of 10 to 30 gf loaded on the cleaner member 4*a* or 4*b* and suspending the pre-selected weight to the end of the moving member 6 upon cleaning the needle electrode 2, cleaning can be conducted under a predetermined pressing force. Alternatively, an electric motor of which a rotational torque has been adjusted may be connected to the end of the moving member 6 so that a predetermined pressing force can be loaded.

The shield case 7 is made of, for example, stainless steel. The shield case 7 is a container-like member of which outer shape is a rectangular parallelepiped with an inner space and which has an opening in one surface facing the above-described photoreceptor drum 30. In the internal space of the shield case 7 are housed at least the needle electrode 2, the holding member 3, the cleaner members 4*a* and 4*b*, and support member 5. Further, the shield case 7 extends long in the same direction as extending direction of the needle electrode 2. A cross sectional configuration of the shield case 7 in a direction perpendicular to a longitudinal direction thereof is substantially U-shaped. Further, a holding member 3 is attached to a bottom 15 of the shield case 7. Moreover, an end of a columnar portion of the support member 5 is inserted slidably into a groove 14 which is formed by an inner lateral surface 13 of the shield case 7 and the holding member 3.

The grid electrode 8 is located between the needle electrode 2 and the photoreceptor drum 30. The grid electrode 8 is a thin plate member to which voltage is applied, for adjusting unevenness in charges on the surface of the photoreceptor drum 30 so as to further equalize the charged potential of the photoreceptor drum 30. The grid electrode 8 can be manufactured in accordance with a heretofore known method. For example, the grid electrode 8 is manufactured by processing a plate metal in a manufacturing method including a chemical polishing step, a water washing step, an acid dipping step, a water washing step, and a pure water dipping step. The plate metal is formed of the same sort of metal materials as those constituting the needle electrode 2, such as stainless steel, aluminum, nickel, copper and iron. Further, at the chemical polishing step, masking and etching are performed on the plate metal so that a large number of through holes are formed therein. To the grid electrode 8 may be applied the nickel plating, the nickel-PTFE composite plating, etc. when needed.

When the charging apparatus 1 is used, the application of the voltage to the needle electrode 2 causes corona discharge whereby the surface of the photoreceptor drum 30 is charged, and the application of predetermined grid voltage to the grid electrode 8 effects equalization in charges on the surface of the photoreceptor drum 30, with the result that the surface of the photoreceptor drum 30 can be charged up to predetermined potential and polarity. Although the needle electrode 2 is used as an electrode for corona discharge in the charging apparatus 1 of the present embodiment, the electrode for corona discharge is not restricted to the needle electrode 2, and a charging wire is also applicable. As the charging wire, those customarily used in the relevant field can be used including, for example, a charging wire formed of a tungsten wire having a wire diameter of 0.06 mm plated with gold.

Referring back to FIG. 1, the exposure unit 31 is disposed so that light corresponding to respective color information emitted by the exposure unit 31 passes between the charging apparatus 1 and the developing section 32 to irradiate the surface of the photoreceptor drum 30 therewith. The exposure unit 31 divides light emitted from a light source into light corresponding to the respective color information of b, c, m, and y inside the unit according to the image information, and exposes to the light corresponding to respective color information the surface of the photoreceptor drum 30 which has been charged by the charging apparatus 1 to a uniform potential. As the exposure unit 31, it is possible to use a laser scanning unit having, for example, a laser emitting portion and a plurality of reflecting mirrors.

The developing section 32 comprises a developer tank 34 and a toner hopper 35. The developer tank 34 is disposed so as to face the surface of the photoreceptor drum 30, and supplies a toner to the electrostatic latent image formed on the surface of the photoreceptor drum 30, to develop the image so that a visible image, i.e., a toner image is formed. Inside the developer tank 34, a developing roller is rotatably disposed at an opening portion of the developer tank 34, more specifically at a position opposed to the photoreceptor drum 30. The developing roller is a roller-shaped member for supplying the toner to the electrostatic latent image on the photoreceptor drum 30. Moreover, together with the developing roller, a supply roller and a stirring roller are provided. The supply roller is a roller-shaped member which is opposed to the developing roller and disposed rotatably, and used to supply the toner to the periphery of the developing roller. The stirring roller is a roller-shaped member which is opposed to the supply roller and disposed rotatably, and used to supply to the periphery of the supply roller a toner being newly supplied from the toner hopper 35 into the developer tank 34. The toner hopper 35 is provided so that a toner refill port (not shown) disposed at a lower portion in a vertical direction of the toner hopper 35 and a toner receiving port (not shown) disposed at an upper portion in a vertical direction of the toner hopper 35 are communicated with each other. The toner hopper 35 refills the developer tank 34 with a toner according to a consumption degree of the toner in the developer tank 34. As the toner being used in this case, any toner used customarily in the relevant field can be used. For example, a toner containing binder resin, a colorant, a charge control agent, a release agent, etc. can be used.

As the binder resin, materials used customarily in the relevant field can be used including, for example, a styrene-based copolymer, polyvinyl chloride, phenolic resin, naturally modified phenolic resin, naturally modified maleic resin, acrylic resin, methacrylic resin, polyvinyl acetate, silicone resin, polyester, polyurethane, polyamide resin, furan resin, epoxy resin, xylene resin, polyvinyl butyral, terpene resin, coumarone-indene resin, and petroleum-based resin.

As the colorant, materials used customarily in the relevant field can be used including, for example, a colorant for yellow toner, a colorant for magenta toner, a colorant for cyan toner, and a colorant for black toner.

Examples of the colorant for yellow toner include: azo pigments such as CI pigment yellow 1, CI pigment yellow 5, CI pigment yellow 12, CI pigment yellow 15, and CI pigment yellow 17; inorganic pigments such as yellow iron oxide and yellow ochre; nitro dyes such as CI acid yellow 1; and oil soluble dyes such as CI solvent yellow 2, CI solvent yellow 6, CI solvent yellow 14, CI solvent yellow 15, CI solvent yellow 19, and CI solvent yellow 21, which are classified according to the color index.

Examples of the colorant for magenta toner include CI pigment red 49, CI pigment red 57, CI pigment red 81, CI pigment red 122, CI solvent red 19, CI solvent red 49, CI solvent red 52, CI basic red 10, and CI disperse red 15, which are classified according to the color index.

Examples of the colorant for cyan toner include CI pigment blue 15, CI pigment blue 16, CI solvent blue 55, CI solvent blue 70, CI direct blue 25, and CI direct blue 86, which are classified according to the color index.

Examples of the colorant for black toner include carbon blacks such as channel black, roller black, disc black, gas furnace black, oil furnace black, thermal black, and acetylene black. Among the various carbon blacks, a suitable carbon black may be appropriately selected according to an intended design characteristic of toner.

The colorant can be used alone or two or more of the materials can be used in combination. Further, two or more materials of the same color series can be used, and one or two or more materials of different color series can be used. A usage of the colorant is, without a particular restriction, preferably 5 to 20 parts by weight based on 100 parts by weight of the binder resin. By using the colorant of which amount is in the above range, various properties of toner are not deteriorated, and it is thus possible to form an image of high density and very high quality.

As the charge control agent, it is possible to use those for positive charge control and for negative charge control, which are used customarily in the relevant field. Examples of the charge control agent for positive charge control include basic dye, quanternary ammonium, aminopyrine, a pyrimidine compound, a polynuclear polyamino compound, aminosilane, and nigrosine dye. Examples of the charge control agent for negative charge control include: oil soluble dyes such as oil black and spilon black; a metal-containing azo compound; metal salt naphthenate; metal salt salicylate; a fatty acid soap; and a resin acid soap. The charge control agent can be used alone or, optionally, two or more of the materials can be used in combination. A usage of the charge control agent can be, without a particular restriction, appropriately selected from a wide range and is preferably 0.5 to 3 parts by weight based on 100 parts by weight of the binder resin.

As the release agent, materials used customarily in the relevant field can be used including: for example, petroleum-based wax such as paraffin wax, a derivative thereof, microcrystalline wax, and a derivative thereof; hydrocarbon-based synthetic wax such as Fischer-Tropsch wax, a derivative thereof, polyolefin wax, a derivative thereof, low-molecular-weight polypropylene wax, and a derivative thereof, low-molecular-weight polyethylene wax, and a derivative thereof; plant-based wax such as carnauba wax, a derivative thereof, rice wax, a derivative thereof, candelilla wax, a derivative thereof, and haze wax; animal-based wax such as bees wax and whale wax; oil and fat-based synthetic wax such as fatty acid amide and phenolic fatty acid ester; long-chain carboxylic acid, and derivative thereof; and long-chain alcohol and a derivative thereof. Note that the derivatives include an oxide, a block copolymer of vinyl-based monomer and wax, and a graft modification of vinyl-based monomer and wax. A usage of the wax can be, without a particular restriction, appropriately selected from a wide range and is preferably 0.2 to 20 parts by weight based on 100 parts by weight of the binder resin.

Furthermore, a fluidity improver may be contained as an external additive. The fluidity improver exerts an effect thereof when mixed with the toner to be thereby attached to a surface of the toner. As the fluidity improver, materials used customarily in the relevant field can be used including, for example, silica, titanium oxide, silicon carbide, and aluminum oxide. The fluidity improver may have been treated with a hydrophobic process.

The hydrophobic process is performed, for example, by mixing the fluidity improver and a hydrophobizing agent. The fluidity improver treated with the hydrophobic process is used as an external additive for the toner owing mainly to its applicability to high-speed image formation. Among the fluidity improvers treated with the hydrophobic process, preferable is hydrophobized silica. In general, the hydrophobized silica is often attached to an electrode etc. of a charging apparatus, and thus decreases a charging ability of the charging apparatus for a photoreceptor drum, resulting in a charging defect. However, when the charging apparatus 1 of the invention is used, even image formation using toner containing hydrophobized silica causes no charging defect, and there are thus caused no defects in images.

As the hydrophobizing agent, materials used customarily in the relevant field can be used including, for example, trimethylsilane, trimethylsilylmercaptan, hexymethyldisilazane, vinyltriethoxysilane, vinyltrimethoxysilane, trimethylsilane, trimethylchlorosilane, trimethylethoxysilane, dimethyldichlorosilane, methyltrichlorosilane, allyldimethylchlorosilane, allylphenylsilane, benzyldimethylchlorosilane, brommethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinylmethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and polyorganosiloxane having a trimethylsilyl group. The fluidity improver can be used alone or two or more of the materials can be used in combination. A usage of the fluidity improver is, without a particular restriction, preferably 0.1 to 3.0 parts by weight based on 100 parts by weight of the toner particles.

After the toner image is transferred onto the later-described transfer belt 36 by the later-described intermediate transfer roller 39, the cleaning unit 33 cleans the surface of the photoreceptor drum 30 by removing the toner remaining on the surface of the photoreceptor drum 30. For the cleaning unit 33, a plate-shaped member such as a cleaning blade is used. In the image forming apparatus according to the invention, an organic photoreceptor drum is used predominantly for the photoreceptor drum 30, and since the surface of the organic photoreceptor drum mainly contains a resin ingredient, the surface tends to be degraded by the chemical action of ozone generated upon the corona discharge conducted by the charging apparatus. However, the degraded surface portion is worn under the frictional rubbing effect brought by the cleaning unit 33, and is removed reliably although gradually. Accordingly, the problem of the degradation of the surface due to the ozone or the like can be actually overcome, and the charged potential of the surface through the charging operation can be maintained stably over a long period of time.

In the toner image forming section 21, the exposure unit 31 irradiates the surface of the photoreceptor drum 30 being evenly charged by the charging apparatus 1 with signal light corresponding to image information, to thereby form an electrostatic latent image to which a toner is supplied form the developing section 32 to thereby form a toner image which is then transferred onto the transfer belt 36, and the toner remaining on the surface of the photoreceptor drum 30 is removed by the cleaning unit 33. A series of the toner image forming operation thus described is repeatedly performed.

The transfer section 22 is located above the photoreceptor drum 30, and comprises a transfer belt 36, a driving roller 37, a driven roller 38, an intermediate transfer roller 39*b*, 39*c*, 39*m*, and 39*y*, a transfer belt cleaning unit 40, and a transfer roller 41. The transfer belt 36 is an endless belt-shaped member which is stretched over the driving roller 37 and the driven roller 38, thereby forming a looped travel path, and is rotated in an arrow B direction. When the transfer belt 36 comes into contact with the photoreceptor drum 30 and passes by the photoreceptor drum 30, there is applied a transfer bias of which polarity is opposite to the polarity of the charged toner on the surface of the photoreceptor drum 30, from the intermediate transfer roller 39 which is disposed opposite to the photoreceptor drum 30 across the transfer belt 36, with the result that the toner image formed on the surface of the photoreceptor drum 30 is transferred onto the transfer belt 36. In the case of full-color image, toner images of respective colors formed at the respective photoreceptor drums 30 are sequentially stacked on the transfer belt 36 so that a full-color image is formed.

The driving roller 37 is disposed so as to be rotatable around an axis thereof by a driving mechanism (not shown), and its rotary drive makes the transfer belt 36 rotate in the arrow B direction. The driven roller 38 is disposed so as to be rotated by the rotary drive of the driving roller 37, and gives a certain level of tension to the transfer belt 36 in order to prevent the transfer belt 36 from going slack. The intermediate transfer roller 39 is disposed to abut on the photoreceptor drum 30 via the transfer belt 36 and be rotatable around an axis thereof by a driving mechanism (not shown). To the intermediate transfer roller 39 is connected a power source (not shown) for applying the transfer bias as described above. The intermediate transfer roller 39 has a function of transferring the toner image on the surface of the photoreceptor drum 30 onto the transfer belt 36.

The transfer belt cleaning unit 40 is disposed opposite to the driven roller 38 across the transfer belt 36 so as to be in contact with an outer circumferential surface of the transfer belt 36. Since the toner attached to the transfer belt 36 through contact with the photoreceptor drum 30 may cause a contamination on a backside of the recording medium, the transfer belt cleaning unit 40 removes and collects the toner on the surface of the transfer belt 36. The transfer roller 41 is disposed so as to abut on the driving roller 37 via the transfer belt 36 and be rotatable around an axis thereof by a driving mechanism (not shown). At an abutting portion (a transfer nip section) formed between the transfer roller 41 and the driving roller 37, the toner image which is carried by the transfer belt 36 and thereby conveyed to the abutting portion, is transferred onto the recording medium fed from the later-described recording medium supply section 24. The recording medium carrying the toner image is fed to the fixing section 23. In the transfer section 22, the toner image transferred from the photoreceptor drum 30 onto the transfer belt 36 at an abutting portion formed between the photoreceptor drum 30 and the intermediate transfer roller 39 is conveyed to the transfer nip portion by the rotary drive of the transfer belt 36 in the arrow B direction and transferred onto the recording medium at the transfer nip portion.

The fixing section 23 is disposed downstream of the transfer section 22 in a conveying direction of the recording medium, and comprises a heating roller 47 and a pressure roller 48, and further comprises a heat source of the heating roller 47, a sensor for detecting a temperature of the heating roller 47, a control circuit for controlling the heat source to operate so that the heating roller 47 attains a predetermined temperature, and other components. The heating roller 47 and the pressure roller 48 abut against each other and are disposed so as to be rotatable by a driving mechanism (not shown). At an abutting portion (a fixing nip portion) formed between the heating roller 47 and the pressure roller 48, the recording medium is nipped under pressure between the heating roller 47 and the pressure roller 48 and thus conveyed. In the fixing section 23, when the recording medium carrying the toner image fed from the transfer section 22 passes through the fixing nip portion, the toner image is heated and pressurized to be fixed on the recording medium so that a solid recording image is formed. In the fixing section 23, the recording medium carrying the toner image passes under heat and pressure through the abutting portion, whereby the toner image is fixed onto the recording medium, resulting in formation of an image.

The recording medium supply section 24 comprises an automatic paper feed tray 42, a pickup roller 43, a conveying roller 44, a registration roller 45, and a manual paper feed tray 46. The automatic paper feed tray 42 is a container-like member for storing recording mediums, which is disposed in a lower portion in a vertical direction of the image forming apparatus 20. Examples of the recording medium include ordinary paper, color copy paper, coated paper, a sheet for overhead projector (OHP sheet), and a postcard. Examples of size of the recording medium include A3, A4, B4, B5, etc. defined by JIS P0138 or JIS P0202 and furthermore a postcard size. Moreover, the size of the recording medium is not limited to those cited above, and an irregular-sized recording medium can be also contained.

The pickup rollers 43 take out the recording medium stored in the automatic paper feed tray 42 sheet by sheet, and then feeds the recording medium to a sheet conveying channel S1. The conveying rollers 44 are a pair of roller members which are disposed so as to abut against each other, and convey the recording medium toward the registration roller 45. The registration rollers 45 are a pair of roller members which are disposed so as to abut against each other, and feed the recording medium fed from the conveying roller 44 to the transfer nip portion in synchronization with conveyance of the toner image carried by the transfer belt 36 to the transfer nip portion. The manual paper feed tray 46 is a device for taking the recording medium into the image forming apparatus 20 by manual operation. The recording medium taken into the image forming apparatus 20 from the manual paper feed tray 46 passes through a sheet conveying channel S2 to be thereby fed to the registration roller 45. The recording medium supply section 24 feeds to the transfer nip portion the recording medium supplied sheet by sheet from the automatic paper feed tray 42 or the manual paper feed tray 46, in synchronization with conveyance of the toner image carried by the transfer belt 36 to the transfer nip portion.

The discharge section 25 comprises the conveying roller 44, a discharge roller 49, and a discharge tray 50. The conveying roller 44 is disposed downstream of the transfer nip portion in a sheet conveying direction, and conveys toward the discharge roller 49 the recording medium on which an image has been fixed by the fixing section 23. The discharge roller 49 discharges the recording medium on which an image has been fixed, to the discharge tray 50 provided on an upper face in the vertical direction of the image forming apparatus 20. The discharge tray 50 piles up thereon the recording medium on which an image has been fixed.

The image forming apparatus 20 is provided with a control unit 60. The control unit 60 is disposed, for example, in an upper part in an internal space of the image forming apparatus 20, and is a processing circuit which includes a control section, a calculation section, a storage section, etc. and is realized by a microcomputer provided with a central processing unit (CPU) or the like element. To the storage section of the control unit 60 are inputted an image forming command transmitted by way of an operation panel (not shown) disposed on an upper face of the image forming apparatus 20, a detection result obtained from a sensor (not shown) or the like component disposed in various parts inside the image forming apparatus 20, image information obtained from an external equipment, and the like element. In the calculation section, various determinations are made on the basis of the inputted various data (the image forming command, the detection result, the image information, or the like element). In accordance with the determined result, the control section transmits a control signal to thereby control an entire operation of the image forming apparatus 20. As the storage section, components used customarily in the relevant field are available, including a read only memory (ROM), a random access memory (RAM), and a hard disk drive (HDD). As the external equipment, it is possible to use an electrical/electronic equipment which can form or obtain image information and which can be electrically connected to the image forming apparatus 20, including a computer, a digital camera, a television, a video recorder, a DVD recorder, and a facsimile apparatus. The control unit 60 includes a power source as well as the above-mentioned processing circuit. The power source supplies electricity to not only the control unit but also various devices inside the image forming apparatus 20.

In the image forming apparatus 20, the toner image formed in the toner image forming section 21 is transferred onto the transfer belt 36 in the transfer section 22; further the toner image on the transfer belt 36 is transferred onto the recording medium; the toner image is fixed on the recording medium by the fixing section 23 so that an image is formed; and the recording medium having an image fixed thereon is discharged to the discharge tray 50 by way of the discharge section 25.

Figure 5:
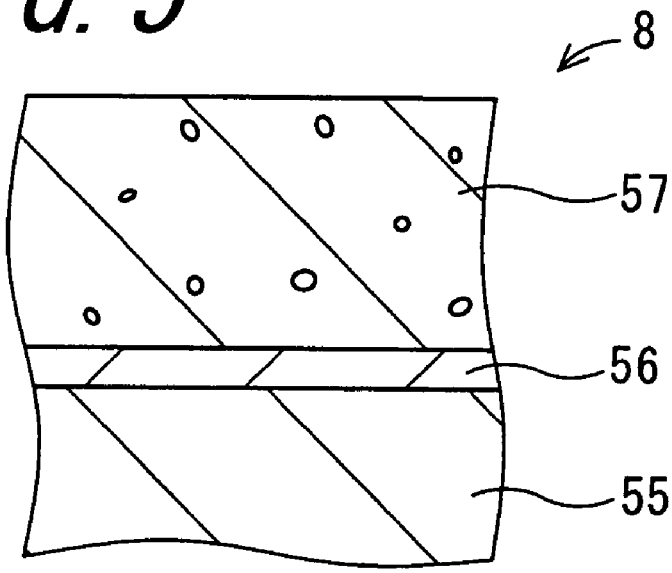
FIG. 5 is a sectional view schematically showing a configuration of a grid electrode used in the charging apparatus according to a second embodiment of the invention.

In the charging apparatus 1 according to the second embodiment of the invention, the grid electrode 8 comprises a porous plate substrate 55 and a nickel-PTFE composite layer 57 formed on an entirety or part of a surface of the porous plate substrate 55, as shown in FIG. 5. The porous plate substrate 55 is formed of a metal such as stainless steel, aluminum, nickel, copper and iron. The nickel-PTFE composite layer 57 is a surface coating layer which is formed by dispersing PTFE primary particles and/or PTFE secondary aggregates in a nickel layer. In some cases, the PTFE primary particles and/or PTFE secondary aggregates are exposed on a surface of the nickel-PTFE composite layer 57. The inventor's study has revealed that, when these particles and/or aggregates fall off the surface of the nickel-PTFE composite layer 57, pinholes are generated in the surface, with the result that an electrode undercoat layer (porous plate substrate 55) of the grid electrode 8 may be exposed. The exposure of the electrode undercoat layer causes the charge control performance of the grid electrode 8 to be decreased or uneven. In view of such a problem, in the invention, a length in minor axis of the PTFE secondary aggregate contained in the nickel-PTFE composite layer 57 is set at twice or less than a layer thickness of the nickel-PTFE composite layer 57, preferably at equal to or less than the layer thickness of the nickel-PTFE composite layer 57, whereby the electrode undercoat layer is prevented from being exposed, thus resulting in the grid electrode 8 which exhibits high charge control performance stably over a long period of time and of which charge control is less uneven.

In the case where the length in minor axis of the PTFE secondary aggregate contained in the nickel-PTFE composite layer 57 becomes larger than twice the layer thickness of the nickel-PTFE composite layer 57, a larger amount of the PTFE secondary aggregate falls off, thus leading an increase in number of the pinholes which expose the electrode undercoat layer. As a result, the charge control performance of the grid electrode 8 becomes more easily uneven. Thus, the potential of the charged surface of the photoreceptor drum 30 may be insufficiently equalized.

Further, the layer thickness of the nickel-PTFE composite layer 57 is preferably larger than a particle diameter of the PTFE primary particle. A preferable particle diameter of the PTFE primary particle contained in the nickel-PTFE composite layer 57 is 0.7 μm or more. Since the nickel-PTFE composite layer 57 contains the PTFE primary particles and the PTFE secondary aggregates as described above, the particle diameter of the PTFE is preferably set so that the diameter of the primary particle is 0.7 μm or more while the length in minor axis of the PTFE secondary aggregate is twice or less than the layer thickness of the nickel-PTFE composite layer 57. Further, the length in minor axis of the PTFE secondary aggregate can be obtained by observation of the surface of the nickel-PTFE composite layer 57 through a scanning electron microscope (abbreviated as SEM, trade name: Real Surface View Microscope) manufactured by Keyence Corporation. That is to say, by using the scanning electron microscope, the surface of the nickel-PTFE composite layer 57 is observed at 500-fold magnification to check whether or not the PTFE secondary aggregate is present in one field, and in the case where the PTFE secondary aggregate is found, the magnification is adjusted to 3,000 so that the length in minor axis of the PTFE secondary aggregate is measured. The length in minor axis indicates the narrowest part of the PTFE secondary aggregate. The observation described above is repeated in 20 fields to then obtain an average thereof which is defined as the length in minor axis of the PTFE secondary aggregate.

The grid electrode 8 can be manufactured in accordance with a heretofore known method. One example of the method is a manufacturing method including a chemical polishing step, a water washing step, an acid dipping step, a water washing step, a pure water dipping step, a nickel plating step, a nickel-PTFE composite plating step, a water washing process, and a drying process. Among those steps, the nickel plating step is not an essential step, but optionally carried out. At the chemical polishing step, masking and etching are performed on a plate metal so that a plurality of through holes are formed in the plate metal. The etching can be conducted in accordance with a heretofore known method, which includes, for example, a method of spraying an etching solution such as an aqueous solution of ferric chloride to the plate metal. As the metal for the material of the plate metal, it is possible to use a material which can be processed into a grid shape and which can be plated. Examples of the material include stainless steel, aluminum, nickel, copper and iron. Among those metals, stainless steel is particularly preferred from the aspect of enhancement in durability of the grid electrode 8. Specific examples of the stainless steel include, for example, SUS304, SUS309 and SUS316. Among those stainless steels, SUS304 is preferred. Further, copper is particularly preferred from the aspect of enhancement in adhesiveness to the nickel-PTFE composite layer 57, reduction in production cost, etc. In the case where copper is used, a nickel plated layer 56 does not have to be formed because of very high adhesiveness of copper to the nickel-PTFE composite layer 57. A thickness of the plate metal is, without a particular restriction, preferably from 0.05 to 1 mm and more preferably from 0.05 to 0.3 mm. The plate metal in which the through holes are formed at the chemical polishing step, is treated with water washing, acid cleaning or pure water cleaning at the water washing, the acid dipping step, the water washing step, and the pure water dipping step, whereby obstacles are removed form the surface so that the porous plate substrate 55 is obtained.

Although the nickel plating step is not an essential step as described above, it is preferable to conduct the step in order to enhance adhesiveness of the nickel-PTFE composite layer 57 to the porous plate substrate. The nickel plating may be conducted in accordance with a commonly-used method, but preferably electroplated in consideration of the following formation of the nickel-PTFE composite layer 57. Further, the layer thickness of the nickel plated layer 56 is, without a particular restriction, preferably 0.03 to 3 μm, more preferably 0.5 to 1.5 μm, and particularly preferably about 1 μm. Note that the surfaces of the porous plate substrate 55 and nickel plated layer 56 may contain defect parts such as a recess formed by contact with other objects and a part on which a chemical substance, an oxide film, and the like material used for the etching, masking, etc. are deposited and remain. A length in minor axis of the defect part thus described is preferably twice or less than the layer thickness of the nickel-PTFE composite layer 57 formed at the later-described nickel-PTFE composite plating step. The length in minor axis of the defect part means the narrowest width of the defect part when the defect part is observed at 3,000-fold magnification through the scanning electron microscope (Real Surface View Microscope). In order to set the length in minor axis of the defect part in a predetermined range, it is only necessary to repeat the water washing, the acid cleaning, the pure water cleaning, etc. Such a configuration further enhances the charge control performance of the final grid electrode 8.

The nickel-PTFE composite plating step can be conducted in accordance with an electroless nickel plating method including a catalytic nickel plating method (Kanigen process). A plating bath for use in the electroless nickel plating method is prepared, for example, by adding polytetrafluoroethylene to an aqueous solution containing hypophosphorous acid or salt thereof and nickel salt. The plating bath is usually adjusted so that its pH falls in a range from 5 to 5.5. Polytetrafluoroethylene being used in this case is particulate polytetrafluoroethylene of which particle diameter is not particularly restricted as long as being smaller than a thickness of plated layer to be formed, and is preferably 1 μm or less and more preferably 100 to 500 nm. An addition amount of polytetrafluoroethylene to the plating bath is not particularly restricted either, and preferably 0.01% to 10% by weight or more preferably 0.1% to 1.0% by weight based on a total weight of the plating bath. Specific examples of the plating bath include "KANIFLON S" (trade name) manufactured by Japan Kanigen Co., Ltd., "NIMUFLON" (trade name) manufactured by C. Uemura & Co., Ltd., and "TOP NICOSITE" series (trade name) manufactured by Okuno Chemical Industries Co., Ltd.

The porous plate substrate 55 is dipped into the plating bath having the composition and pH as described above at bath temperature of 90° C. so that the electroless nickel plating is carried out, whereby the nickel-PTFE composite layer 57 is formed on the surface of the substrate. A PTFE content in the nickel-PTFE composite layer 57 thus formed is preferably 3% to 30% by volume and more preferably 10% to 20% by volume. A layer thickness of the nickel-PTFE composite layer 57 thus formed is not particularly restricted, and is preferably equal to or more than a particle diameter of the PTFE particle, more preferably twice as large as the particle diameter of the PTFE particle to 20 μm, and particularly preferably twice as large as the particle diameter of the PTFE particle to 10 μm. In the nickel-PTFE composite layer 57 of which thickness is less than the particle diameter of the PTFE particle, there are easily generated pinholes by fall of a PTFE particle-sized part of the nickel-PTFE composite layer 57. As a result, the nickel-PTFE composite layer 57 becomes uneven, and the grid substrate easily corrodes at the pinholes, thereby causing the charged potential of the photoreceptor to be liable to become partially unstable. On the other hand, in the nickel-PTFE composite layer 57 of which thickness largely exceeds 20 μm, a plating film may possible be peeled off due to stress. Note that the thickness of the nickel-PFTE composite layer 57 is substantially proportional to a length of the plating time and therefore, it is only necessary to appropriately change a length of dipping time of the porous plate substrate into the plating bath in order to obtain a desired layer thickness.

Since a liquid agent contained in the plating bath is deposited uniformly on the surface of the porous plate substrate 55, the nickel-PTFE composite layer 57 formed by the electroless plating has a favorable characteristic that the layer is uniform with no variation in thickness even in the case where the layer is so thin as about the particle diameter of the PTFE particle. Further, the plating structure is dense and has high adhesiveness to the surface of the porous plate substrate 55 and even when used for a long time, no peeling or the like is caused.

At the nickel-PTFE composite plating step, in order to obtain the nickel-PTFE composite layer 57 defined in the invention, it is only necessary to appropriately change the content (% by volume) of the PTFE particles, the bath temperature of the plating bath, the plating time, and the other plating conditions. For example, the plating bath is depressurized shortly before the plating process to expel oxygen or the like gas which is dissolved in the plating bath, to thereby prevent bubbles from arising in the plating bath during the plating process and moreover, the bath temperature of the plating bath is maintained to be in a range from 90° C. to 92° C. while the plating time is set at 5 to 60 minutes. Other than the depressurizing process, an applicable degassing process is ultrasonic vibration or stirring for a predetermined length of time at the bath temperature during the plating process. Further, the nickel-PTFE composite plating step can be conducted by electroplating. In the electroplating, it is possible to use the same plating bath as that used in the electroless plating. The conditions for the electroplating are the same as those set for general nickel electroplating. The nickel-PTFE composite plating using the electroplating exhibits an electroplating-specific tendency, that is, a tendency that an edge part is easily plated while a part of the porous plate substrate 55 where a through hole is formed is hard to be plated. Accordingly, in order to make the layer thickness of the plated layer uniform, it is necessary to increase the layer thickness preferably to 3 μm or more. Note that, upon forming the nickel-PTFE composite layer 57, either of the electroless plating and the electroplating may be selected according to features and costs of respective plating methods.

When the charging apparatus 1 is used, the application of the voltage to the needle electrode 2 causes corona discharge whereby the surface of the photoreceptor drum 30 is charged, and the application of predetermined grid voltage to the grid electrode 8 effects equalization in charges on the surface of the photoreceptor drum 30, with the result that the surface of the photoreceptor drum 30 can be charged up to predetermined potential and polarity. Although the needle electrode 2 is used as an electrode for corona discharge in the charging apparatus 1 of the present embodiment, the electrode for corona discharge is not restricted to the needle electrode 2, and a charging wire is also applicable. As the charging wire, those customarily used in the relevant field can be used including, for example, a charging wire formed of a tungsten wire having a wire diameter of 0.06 mm plated with gold.

EXAMPLE

The invention will be described specifically with reference to examples.

Example 1

A plate metal made of stainless steel (SUS304) (sized 20 mm×310 mm×0.1 mm thickness) were treated with a masking process and an etching process, thereby preparing a discharging electrode substrate. The etching was conducted by spraying an aqueous 30 wt % solution of ferric chloride to the plate metal of stainless steel at a liquid temperature of 90° C. for 2 hours. After the etching, the plate metal was taken out of the etching solution, and subjected to water washing and cleaning with pure water. The discharging electrode substrate was thus manufactured.

On a surface of the discharging electrode substrate obtained as described above was formed an Ni plating layer of 0.5 μm thickness by means of electric plating. And then, the discharging electrode substrate having the Ni plating layer formed thereon was dipped for 30 min into a nickel-PTFE composite plating bath (bath temperature: 90° C.) which would serve as a finishing plating layer. The nickel-PTFE composite plating bath had been prepared by dispersion of such an amount of PTFE particles having a particle diameter of 1 μm that a PTFE particle content would be 18% by volume, followed by a degassing process (depressurized to 1/10 pressure for a degassing time of 10 min). As a result, there was manufactured a needle electrode having a surface thereof provided with the nickel-PTFE composite layer of which thickness in flat part was 10 μm. Note that as the nickel-PTFE composite plating bath, there was used NIMUFLON (trade name) manufactured by C. Uemura & Co., Ltd. which had been treated with adjustment of the PTFE particle content and the degassing process as described above. A surface of the nickel-PTFE composite layer thus formed was observed by a scanning electron microscope (Real Surface View Microscope) at 500-fold and 3,000-fold magnifications, with the result that any PTFE secondary aggregate of which length in minor axis exceeded 10 μm was not recognized. Moreover, no pinhole was recognized either.

Comparative Example 1

The PTFE particles having a particle diameter of 1.0 μm were replaced by PTFE particles having a particle diameter of 0.2 μm, the PTFE particle content in the finishing plating layer is changed from 18% by volume to 23% by volume, and no degassing process was conducted. The other conditions were set as those of the Example 1. There was thus manufactured a needle electrode having a surface thereof provided with a nickel-PTFE composite layer of which thickness was 3 μm. A surface of the nickel-PTFE composite layer thus formed was observed by a scanning electron microscope (Real Surface View Microscope) at 500-fold and 3,000-fold magnifications, with the result that PTFE secondary aggregates of which length in minor axis exceeded 2 μm were recognized, and the PTFE particles were unevenly dispersed. Moreover, pinholes were also observed.

Comparative Example 2

A plate metal made of stainless steel (SUS304) (sized 20 mm×310 mm×0.1 mm thickness) were treated with a masking process and an etching process, thereby preparing a discharging electrode substrate. The etching was conducted by spraying an aqueous 30 wt % solution of ferric chloride to the plate metal of stainless steel at a liquid temperature of 90° C. for 2 hours. After the etching, the plate metal was taken out of the etching solution, and subjected to water washing and cleaning with pure water. The discharging electrode substrate was thus manufactured, and used as a needle electrode. The needle electrodes obtained in the Example 1 and Comparative Examples 1 and 2 replaced a needle electrode of a charging apparatus in a commercially available image forming apparatus (trade name: AR625, manufactured by Sharp Corp.). There were thus manufactured an image forming apparatus of the invention and a charging apparatus of the invention. The following test was conducted by use of the needle electrode, the charging apparatus and the image forming apparatus.

[Discharging Test]

Figure 6:
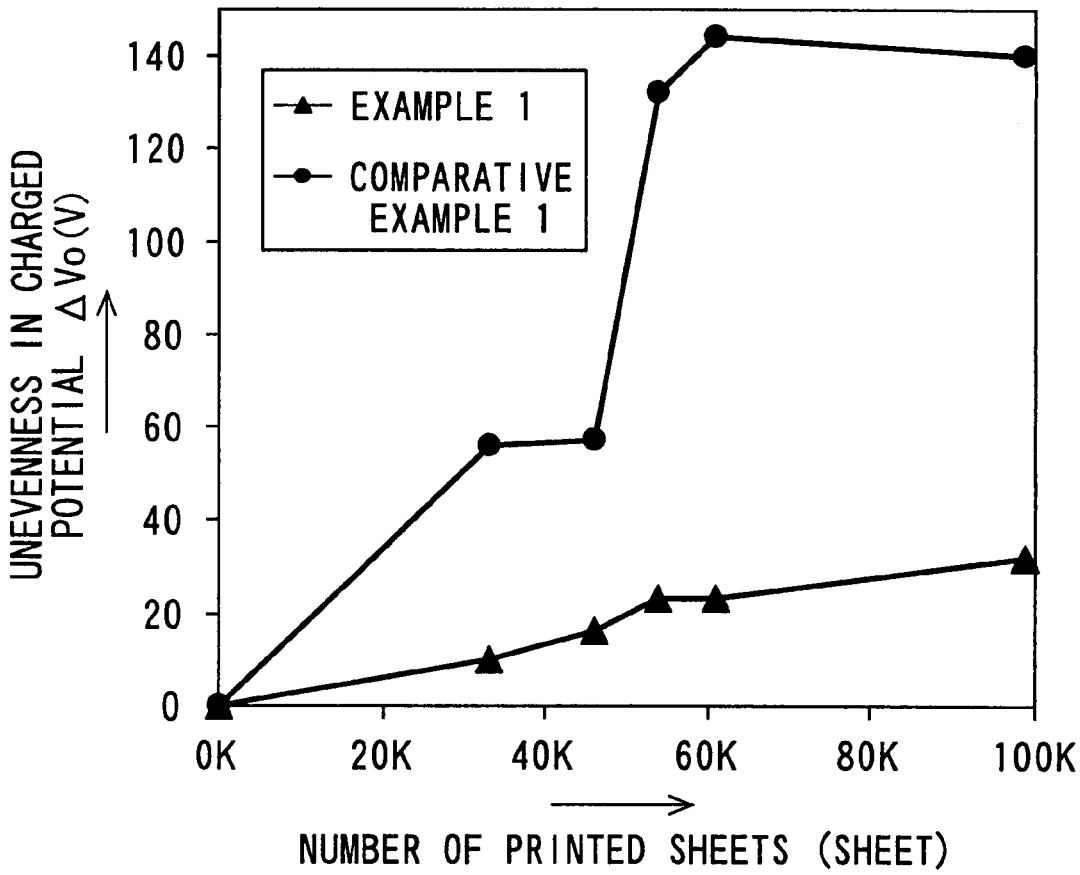
FIG. 6 is a graph showing a relationship between unevenness in charged potential (V) of a photoreceptor surface and the number of printed sheets.

As a test under harsh conditions, an aging test with no paper passing under a low humidity condition (10% or lower) was conducted. Since AR625 is a 70 sheet machine, 24 hours correspond to the number of copies (100,000 sheets). In the test, the potential of the charged surface of the photoreceptor was set at −630 V at the initial state. When the needle electrode obtained in the Example 1 was used, a uniform image quality and no unevenness were obtained in a halftone image even after 100,000 copies. When the needle electrode obtained in the Comparative Example 1 was used, image unevenness was recognized after 100,000 copies. In the case of the Comparative Example 2, it was turned out that, at a stage when 20,000 sheets had been copied, a halftone image suffers from image defects such as white streaks and black streaks which indicate a need of cleaning the needle electrode. Further, as to the needle electrodes obtained in the Example 1 and Comparative Example 1, a relationship between the unevenness in charged potential of a photoreceptor surface and the number of printed sheets (the number of copies) is shown in FIG. 6. FIG. 6 is a graph showing the relationship between the unevenness in charged potential (V) of a photoreceptor surface and the number of printed sheets. In FIG. 6, "K" shown in an abscissa axis representing the number of printed sheets indicates "1,000". Accordingly, the number of printed sheets shown in FIG. 6 is 0 to 100,000. It is obvious from FIG. 6 that the use of the needle electrode obtained in the Example 1 results in an extremely narrow width of unevenness in charges even in the case of printing 100,000 sheets. In contrast, it can be seen that when the needle electrode obtained in the Comparative Example 1 is used, a width of unevenness in charges becomes wider after 40,000 sheets have been printed. That is to say, the unevenness in charges after 100,000 sheets have been printed is included within 30 V in the case of the Example 1 while the unevenness in charges rises up to 56 V at the point of 30,000 sheets printed and exceeds 140 V at the point of 60,000 sheets printed in the case of the Comparative Example 1.

[Detection of Nitrogen Oxide and Rust]

Rust and nitrogen oxides were detected by microscopic observation on the needle electrode after discharging. There were no rust etc. generated on the plated needle electrodes obtained in the Example 1 and Comparative Example 1. In contrast, the rust etc. was recognized on the needle electrode obtained in the Comparative Example 2. Further, it was found that when the needle electrodes obtained in the Example 1 and Comparative Example 1 are used, the surface smoothness which is a feature of the nickel-PTFE composite layer, leads a feature that attachments such as dust in air are smaller compared to the needle electrode left in the state of the stainless material obtained in the Comparative Example 2, and allows the attachments to be easily removed at a cleaning occasion.

Further, it can be seen that, in the case of the Example 1 where the PTFE particles having a primary particle diameter of 1 μm are used, there exists no secondary aggregate of which size exceeds twice a layer thickness of the nickel-PTFE composite layer so that a favorable dispersion state including no agglomeration can be obtained. In contrast, in the case of the Comparative Example 1 where the PTFE particles having a primary particle diameter of 0.2 μm are used, prominent agglomeration of the PTFE particles was recognized by microscopic observation. On the basis of involvement of the van der Waals' force which is proportional to a squared particle diameter, in the agglomerating force of fine particles, it is obvious from the results of the Example 1 and Comparative Example 1 that the use of the PTFE particles having a primary particle diameter of 0.7 μm or more prevents generation of the PTFE secondary aggregate having a length in minor axis which exceeds twice the layer thickness of the nickel-PTFE composite layer.

Example 2

A grid substrate made of stainless steel (SUS304) (sized 30 mm×370 mm×0.1 mm thickness) were treated with an etching process, thereby preparing a porous plate substrate. The etching was conducted by spraying an aqueous 30 wt % solution of ferric chloride to the grid substrate of stainless steel at a liquid temperature of 90° C. for 2 hours. After the etching, the grid substrate was subjected to water washing and cleaning with pure water. The porous plate substrate was thus manufactured. On a surface of the porous plate substrate obtained as described above was formed an Ni plating layer of 0.5 μm thickness by means of electric plating. And then, the porous plate substrate having the Ni plating layer formed thereon was dipped for 15 min into a nickel-PTFE composite plating bath (bath temperature: 90° C.) which would serve as a finishing plating layer. The nickel-PTFE composite plating bath had been prepared by dispersion of such an amount of PTFE particles having a particle diameter of 1 μm that a PTFE particle content would be 18% by volume, followed by a degassing process (depressurized to 1/10 pressure for a degassing time of 10 min). As a result, there was manufactured a grid electrode having a surface thereof provided with the nickel-PTFE composite layer of which thickness was 3 μm. Note that as the nickel-PTFE composite plating bath, there was used NIMUFLON (trade name) manufactured by C. Uemura & Co., Ltd. which had been treated with adjustment of the PTFE particle content and the degassing process as described above. A surface of the nickel-PTFE composite layer thus formed was observed by a scanning electron microscope (Real Surface View Microscope) at 500-fold and 3,000-fold magnifications, with the result that any PTFE secondary aggregate of which length in minor axis exceeded 3 μm was not recognized. Moreover, no pinhole was recognized either.

Comparative Example 3

The PTFE particles having a particle diameter of 1.0 μm were replaced by PTFE particles having a particle diameter of 0.2 μm, the PTFE particle content in the finishing plating layer is changed from 18% by volume to 23% by volume, and no degassing process was conducted. The other conditions were set as those of the Example 1. There was thus manufactured a grid electrode having a surface thereof provided with a nickel-PTFE composite layer of which thickness was 3 μm. A surface of the nickel-PTFE composite layer thus formed was observed by a scanning electron microscope (Real Surface View Microscope) at 500-fold and 3,000-fold magnifications, with the result that PTFE secondary aggregates of which length in minor axis exceeded 2 μm were recognized, and the PTFE particles were unevenly dispersed. Moreover, pinholes were also observed.

Comparative Example 4

A grid substrate made of stainless steel (SUS304) (sized 30 mm×370 mm×0.1 mm thickness) were treated with an etching process, thereby preparing a porous plate substrate. The etching was conducted by spraying an aqueous 30 wt % solution of ferric chloride to the grid substrate at a liquid temperature of 90° C. for 2 hours. After the etching, the grid substrate was subjected to water washing and cleaning with pure water. The porous plate substrate was thus manufactured, and used as a needle electrode. The grid electrodes obtained in the Example 2 and Comparative Examples 3 and 4 replaced a grid electrode of a charging apparatus in a commercially available image forming apparatus (trade name: AR625, manufactured by Sharp Corp.). There were thus manufactured an image forming apparatus including a charging apparatus of the invention. The following test was conducted by use of the grid electrode, the charging apparatus and the image forming apparatus.

[Discharging Test]

Figure 7:
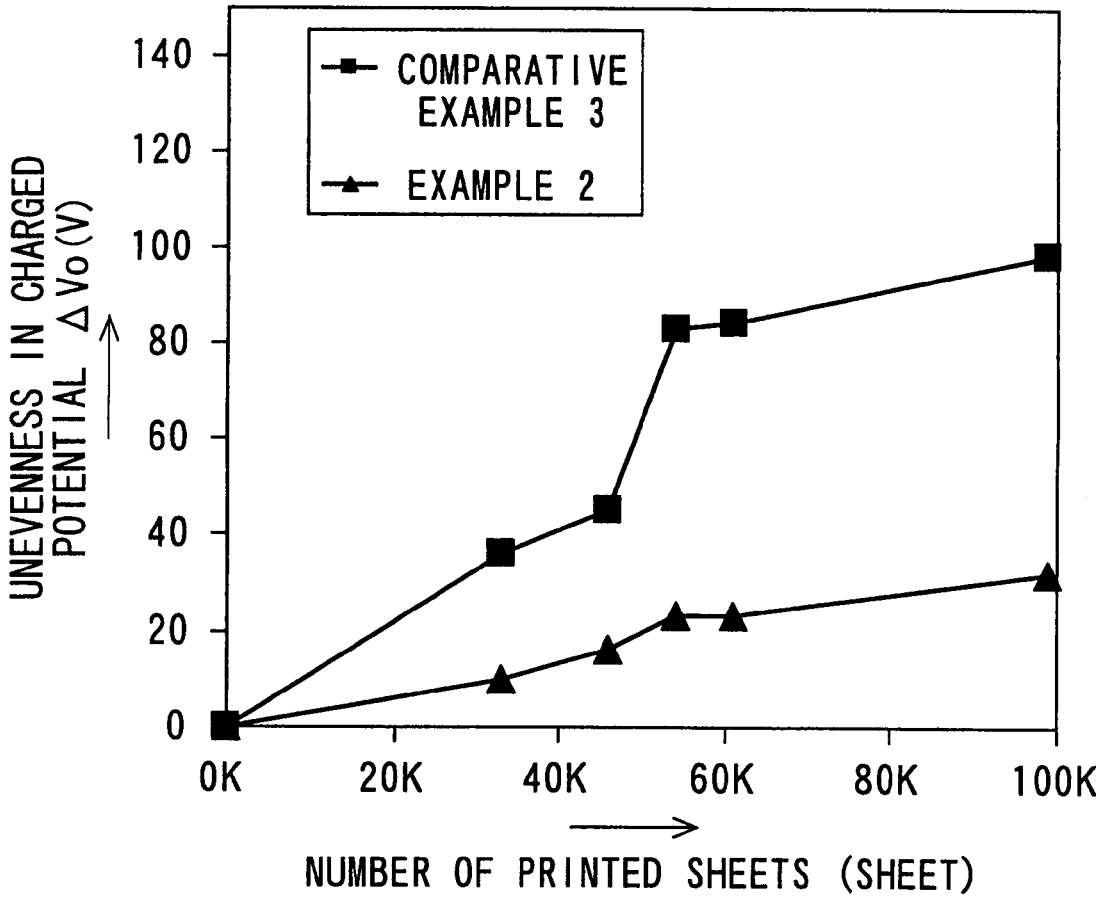
FIG. 7 is a graph showing a relationship between unevenness in charged potential (V) of a photoreceptor surface and the number of printed sheets.

As a test under harsh conditions, an aging test with no paper passing under a low humidity condition (10% or lower) was conducted. Since AR625 is a 70 sheet machine, 24 hours correspond to the number of copies (100,000 sheets). In the test, the potential of the charged surface of the photoreceptor was set at −630 V at the initial state. When the grid electrode obtained in the Example 2 was used, a uniform image quality and no unevenness were obtained in a halftone image even after 100,000 copies. When the needle electrode obtained in the Comparative Example 3 was used, image unevenness was slight but recognized after 100,000 copies. In the case of the Comparative Example 4, it was turned out that, at a stage when 50,000 sheets had been copied, image defects such as white streaks and black streaks were generated in a halftone image. Further, as to the grid electrodes obtained in the Example 2 and Comparative Example 3, a relationship between the unevenness in charged potential (V) of a photoreceptor surface and the number of printed sheets (the number of copies) is shown in FIG. 7. FIG. 7 is a graph showing the relationship between the unevenness in charged potential (V) of a photoreceptor surface and the number of printed sheets. In FIG. 7, "K" shown in an abscissa axis representing the number of printed sheets indicates "1,000". Accordingly, the number of printed sheets shown in FIG. 7 is 0 to 100,000. It is obvious from FIG. 7 that the use of the needle electrode obtained in the Example 2 results in an extremely narrow width of unevenness in charges even in the case of printing 100,000 sheets. In contrast, it can be seen that when the needle electrode obtained in the Comparative Example 3 is used, a width of unevenness in charges becomes wider after 40,000 sheets have been printed. That is to say, the unevenness in charges after 100,000 sheets have been printed was included within 30 V in the case of the Example 2 while the unevenness in charges rose up to 45 V at the point of 50,000 sheets printed and reached 98 V at the point of 100,000 sheets printed in the case of the Comparative Example 3.

[Detection of Nitrogen Oxide and Rust]

Rust and nitrogen oxides were detected by microscopic observation on the surface of the grid electrode after discharging. In the case of using the grid electrode obtained in the Example 2, no rust etc. was detected. In contrast, in the case of using the grid electrode obtained in the Comparative Example 4, the rust etc. was recognized. Further, it was found that when the grid electrodes obtained in the Example 2 and Comparative Example 3 are used, the surface smoothness which is a feature of the nickel-PTFE composite layer, leads a feature that attachments attributable to dust in air are smaller compared to the needle electrode left in the state of the stainless material obtained in the Comparative Example 4, and allows the attachments to be easily removed at a cleaning occasion.

Further, it can be seen that, in the case of the Example 2 where the PTFE particles having a primary particle diameter of 1 μm are used, there exists no secondary aggregate of which size exceeds twice a layer thickness of the nickel-PTFE composite layer so that a favorable dispersion state including no agglomeration can be obtained. In contrast, in the case of the Comparative Example 3 where the PTFE particles having a primary particle diameter of 0.2 μm are used, prominent agglomeration of the PTFE particles was recognized by microscopic observation. On the basis of involvement of the van der Waals' force which is proportional to a squared particle diameter, in the agglomerating force of fine particles, it is obvious from the results of the Example 2 and Comparative Example 3 that the use of the PTFE particles having a primary particle diameter of 0.7 μm or more prevents generation of the PTFE secondary aggregate having a length in minor axis which exceeds twice the layer thickness of the nickel-PTFE composite layer.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging apparatus mounted in an electrophotographic image forming apparatus including a photoreceptor to be opposite to a surface of the photoreceptor, the charging apparatus comprising:

a discharging electrode having a plurality of pointed protrusions, that applies voltage to the surface of the photoreceptor to charge the surface of the photoreceptor; and a grid electrode disposed between the discharging electrode and the photoreceptor, that controls a charged potential of the surface of the photoreceptor, wherein at least one of surfaces of the discharging electrode is provided with a particle polytetrafluoroethylene-containing nickel layer which contains a secondary aggregate of a primary particle polytetrafluoroethylene, and a length in minor axis of the secondary aggregate of the primary particle polytetrafluoroethylene contained in the particle polytetrafluoroethylene-containing nickel layer is, at most, twice a layer thickness of the particle polytetrafluoroethylene-containing nickel layer, wherein a diameter of the primary particle polytetrafluoroethylene contained in the particle polytetrafluoroethylene-containing nickel layer is 0.7 μm or more.

2. The charging apparatus of claim 1, wherein the particle polytetrafluoroethylene-containing nickel layer is formed on the discharging electrode or a surface of a nickel layer formed on the surface of the discharging electrode, and a length in minor axis of a defect part in the discharging electrode or surface of the nickel layer coated with the particle polytetrafluoroethylene-containing nickel layer is, at most, twice the layer thickness of the particle polytetrafluoroethylene-containing nickel layer.

3. The charging apparatus of claim 1, wherein the particle polytetrafluoroethylene-containing nickel layer is formed by an electroless plating method.

4. The charging apparatus of claim 1, wherein a layer thickness of the particle polytetrafluoroethylene-containing nickel layer is larger than the diameter of primary particle of polytetrafluoroethylene.

5. The charging apparatus of claim 1, wherein a nickel plated layer is further formed between the discharging electrode and the particle polytetrafluoroethylene-containing nickel layer.

6. An image forming apparatus comprising:

a photoreceptor on a surface of which an electrostatic latent image is formed;

a charging section for charging the surface of the photoreceptor;

an exposure section that irradiates a charged surface of the photoreceptor with signal light which is based on image information to thereby form the electrostatic latent image;

a developing section that supplies a toner to the electrostatic latent image on the surface of the photoreceptor to thereby form a toner image;

a transfer section that transfers the toner image onto a recording material; and a fixing section that fixes the toner image transferred on the recording material, wherein the charging section is the charging apparatus of claim 1.

7. The image forming apparatus of claim 6, wherein a toner contains hydrophobic silica as an external additive.

8. The image forming apparatus of claim 6, further comprising a cleaning section that removes a toner remaining on the surface of the photoreceptor after the toner image has been transferred onto the recording material, wherein the charging section is disposed vertically below the developing section or the cleaning section.

9. A charging apparatus mounted in an electrophotographic image forming apparatus including a photoreceptor to be opposite to a surface of the photoreceptor, the charging apparatus comprising:

a discharging electrode having a plurality of pointed protrusions, that applies voltage to the surface of the photoreceptor to charge the surface of the photoreceptor; and a grid electrode disposed between the discharging electrode and the photoreceptor, that controls a charged potential of the surface of the photoreceptor, wherein at least one of surfaces of the discharging electrode is provided with a particle polytetrafluoroethylene-containing nickel layer which contains a secondary aggregate of a primary particle polytetrafluoroethylene, and a length in minor axis of the secondary aggregate of a primary particle polytetrafluoroethylene contained in the particle polytetrafluoroethylene-containing nickel layer is, at most, twice a layer thickness of the particle polytetrafluoroethylene-containing nickel layer, wherein the particle polytetrafluoroethylene-containing nickel layer contains phosphorus together with nickel.

10. A charging apparatus mounted in an electrophotographic image forming apparatus including a photoreceptor to be opposite to a surface of the photoreceptor, the charging apparatus comprising:

a discharging electrode having a plurality of pointed protrusions, that applies voltage to the surface of the photoreceptor to charge the surface; and a grid electrode disposed between the discharging electrode and the photoreceptor, which is provided with a porous plate substrate and a particle polytetrafluoroethylene-containing nickel layer formed on an entirety or part of a surface of the porous plate substrate, wherein a length in minor axis of a secondary aggregate of a primary particle polytetrafluoroethylene contained in the particle polytetrafluoroethylene-containing nickel layer is, at most, twice a layer thickness of the particle polytetrafluoroethylene-containing nickel layer, wherein a diameter of primary particle polytetrafluoroethylene contained in the particle polytetrafluoroethylene-containing nickel layer is 0.7 μm or more.

11. The charging apparatus of claim 10, wherein the particle polytetrafluoroethylene-containing nickel layer is formed on the grid electrode or a surface of a nickel layer formed on a surface of the grid electrode, and a length in minor axis of a defect part in the grid electrode or surface of the nickel layer coated with the particle polytetrafluoroethylene-containing nickel layer is, at most, twice the layer thickness of the particle polytetrafluoroethylene-containing nickel layer.

12. The charging apparatus of claim 10, wherein the particle polytetrafluoroethylene-containing nickel layer is formed by an electroless plating method.

13. The charging apparatus of claim 10, wherein a layer thickness of the particle polytetrafluoroethylene-containing nickel layer is larger than the diameter of the primary particles of polytetrafluoroethylene.

14. The charging apparatus of claim 10, wherein a nickel plated layer is further formed between the porous plate substrate and the particle polytetrafluoroethylene-containing nickel layer.

15. The charging apparatus of claim 10, wherein the particle polytetrafluoroethylene-containing nickel layer contains phosphorus together with nickel.

16. The charging apparatus of claim 10, wherein the porous plate substrate is a porous stainless steel plate or a porous copper plate.

17. An image forming apparatus comprising:

a photoreceptor on a surface of which an electrostatic latent image is formed;

a charging section for charging the surface of the photoreceptor;

an exposure section that irradiates a charged surface of the photoreceptor with signal light which is based on image information to thereby form the electrostatic latent image;

a developing section that supplies a toner to the electrostatic latent image on the surface of the photoreceptor to thereby form a toner image;

a transfer section that transfers the toner image onto a recording material; and a fixing section that fixes the toner image transferred on the recording material, wherein the charging section is the charging apparatus of claim 10.

18. The image forming apparatus of claim 17, wherein a toner contains hydrophobic silica as an external additive.

19. The image forming apparatus of claim 17, further comprising a cleaning section that removes a toner remaining on the surface of the photoreceptor after the toner image has been transferred onto the recording material, wherein the charging section is disposed vertically below the developing section or the cleaning section.

* * * * *